US005735079A

United States Patent [19]

Davlantes

[11] Patent Number: 5,735,079

[45] Date of Patent: Apr. 7, 1998

[54] PET DOOR ASSEMBLY

[76] Inventor: George N. Davlantes, 21457 Iglesia Dr., Woodlawn Hills, Calif. 91364

[21] Appl. No.: 635,744

[22] Filed: Apr. 22, 1996

Related U.S. Application Data

[63] Continuation-in-part of Ser. No. 595,231, Feb. 1, 1996, and Ser. No. 595,275, Feb. 1, 1996, Pat. No. 5,657,592.

[51] Int. Cl.[6] ..... E05D 15/48; E05F 11/52

[52] U.S. Cl. ..... 49/169; 49/504

[58] Field of Search ..... 49/169, 168, 505, 49/504

[56] References Cited

U.S. PATENT DOCUMENTS

| | | | |
|---|---|---|---|
| D. 334,431 | 3/1993 | Davlantes | D25/60 |
| D. 334,810 | 4/1993 | Davlantes | D25/60 |
| D. 351,029 | 9/1994 | Davlantes | D25/60 |
| D. 353,207 | 12/1994 | Davlantes | D25/48 |
| 4,408,416 | 10/1983 | Davlantes | 49/168 |
| 4,440,518 | 4/1984 | Davlantes | 403/297 |
| 4,754,797 | 7/1988 | Sronce | 49/169 X |
| 4,760,872 | 8/1988 | Hale, Jr. | 49/169 X |
| 5,269,097 | 12/1993 | Davlantes | 49/169 |
| 5,287,654 | 2/1994 | Davlantes | 49/169 |
| 5,406,748 | 4/1995 | Davlantes | 49/169 |

*Primary Examiner*—Kenneth J. Dorner
*Assistant Examiner*—Curtis Cohen
*Attorney, Agent, or Firm*—Lahive & Cockfield, LLP; Thomas V. Smurzynski; Anthony A. Laurentano

[57] ABSTRACT

A pet door assembly for insertion within a hole formed in a wall having a pair of exterior frames and an inner frame. The exterior frame members mount to opposite sides of the wall and define an opening for allowing passage of a pet. The central inner frame is located between the pair of exterior frames and define an opening generally aligned with the openings in the exterior frames. Each of the exterior frames includes a rear surface having a plurality of fastener sleeves extending outwardly therefrom. At least one of the sleeves has a longitudinally extending slot formed therein. Additionally, the central frame has at least one fastener bracket formed along opposed edges of the inner frame. The bracket includes one or more fastener-receiving apertures having a key portion that is configured to seat within the slot formed within the fastener sleeve. The mating engagement of the fastener sleeve and the key prevents movement of one or both of the exterior frames relative to the inner frame.

16 Claims, 21 Drawing Sheets

PET DOOR ASSEMBLY

REFERENCE TO RELATED APPLICATIONS

This application is a continuation-in-part application of copending application Ser. No. 08/595,231, entitled "Pet Door Having a Security Cover", filed Feb. 1, 1996, and application Ser. No. 08/595,275 now U.S. Pat. No. 5,657,592, entitled "Pet Door Having a Centrally Mounted Door Flap", filed Feb. 1, 1996.

BACKGROUND OF THE INVENTION

The present invention relates to pet access doors, and more particularly to a modular pet access door having a security cover.

Pet access doors that allow the ingress and egress of pets relative to an enclosure exist and are known. Prior pet doors consist principally of a pair of external frame members, e.g., an outer and inner frame member, that mount over a hole cut into a wall, e.g., a door, of the enclosure to define a passageway. Modern pet door systems also employ adjustable spacer frames, which mount between the frame members in a telescoping relationship, to allow the pet door to accommodate a variety of door widths. A swingable flap is secured to the upper portion of the pet door and, when vertically hung, overlies the passageway. The flap is generally secured to the inner external frame member by associated mounting structure and hardware. A drawback of securing the flap to the external frame is that a number of associated assembly pieces are required to affix properly the flap to the frame.

For security purposes, a security cover or panel can be secured to the inner frame member to prevent unwanted entry through the pet door, such as by the hand of an intruder. The panel typically is affixed to the inner frame by slidably mounting the cover within a channel formed in the inner frame. A drawback of prior pet doors that employ security covers is that the application of a force normal to the surface of the cover can disengage the cover front the channel, and thus from the pet door frame.

Due to the foregoing and other shortcomings of pet doors, an object of this invention is to provide a pet door assembly that employs a security cover that affixes to the inner frame member to prevent unwanted dislodgement therefrom.

Another object of the invention is to provide a pet door assembly that employs a centrally mounted flap.

Still another object of the invention is to provide a pet door assembly that includes a flap that mounts to one or more spacer frames.

Yet another object of the invention is to provide a pet door assembly that has relatively few components and is relatively easy to use.

Other general and more specific objects of the invention will in part be obvious and will in part appear from the drawings and description which follow.

SUMMARY OF THE INVENTION

The present invention attains these and other objects of the invention by providing a pet door assembly for insertion within a hole formed in a wall. The pet door assembly includes a pair of exterior frames and an inner frame. The exterior frame members mount to opposite sides of the wall and define an opening for allowing passage of a pet. The central inner frame is located between the pair of exterior frames and defines an opening generally aligned with the openings in the exterior frames. According to one aspect, each of the exterior frames includes a rear surface having a plurality of fastener sleeves extending outwardly therefrom. According to one embodiment, at least one of the sleeves has a longitudinally extending slot formed therein.

According to another aspect, the central frame has at least one fastener bracket formed along opposed edges of the inner frame. The bracket includes a fastener-receiving aperture having a key portion that is configured to seat within the slot formed within the fastener sleeve. The mating engagement of the fastener sleeve and the key prevents movement of one or both of the exterior frames relative to the inner frame. According to a preferred practice, the fastener bracket includes first and second fastener-receiving apertures that have a selected length. The apertures can be vertically or horizontally aligned.

According to still another aspect, the key portion is formed within one of the fastener-receiving apertures. According to a preferred practice, the key portion includes a first key portion having a first height which extends at least partly along the length of the aperture, and a second key portion having a second height which extends at least partly along the aperture, where the first key height is greater than the second key height.

According to still another aspect, each exterior frame has an attachment element formed in a front surface at locations corresponding to the location of the fastener sleeves formed on the other exterior frame. The attachment element, which can include an aperture formed along the vertical sides of the exterior frame, can cooperate with a fastener to attach the exterior frames to the inner frame.

According to yet another aspect, the attachment element, fastener sleeve and fastener bracket apertures align to allow the passage of selected fasteners. According to one practice, one of the exterior frame is aligned with the first fastener-receiving aperture of the fastener bracket, thus placing one of the fastener sleeves of the other exterior frame in registration with the first aperture. Similarly, the attachment element of the other exterior frame is aligned with the second fastener-receiving aperture, thus placing one of the fastener sleeves of the foregoing exterior frame in registration with the second aperture.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions and relationships.

DESCRIPTION OF ILLUSTRATED EMBODIMENTS

Figure 1:
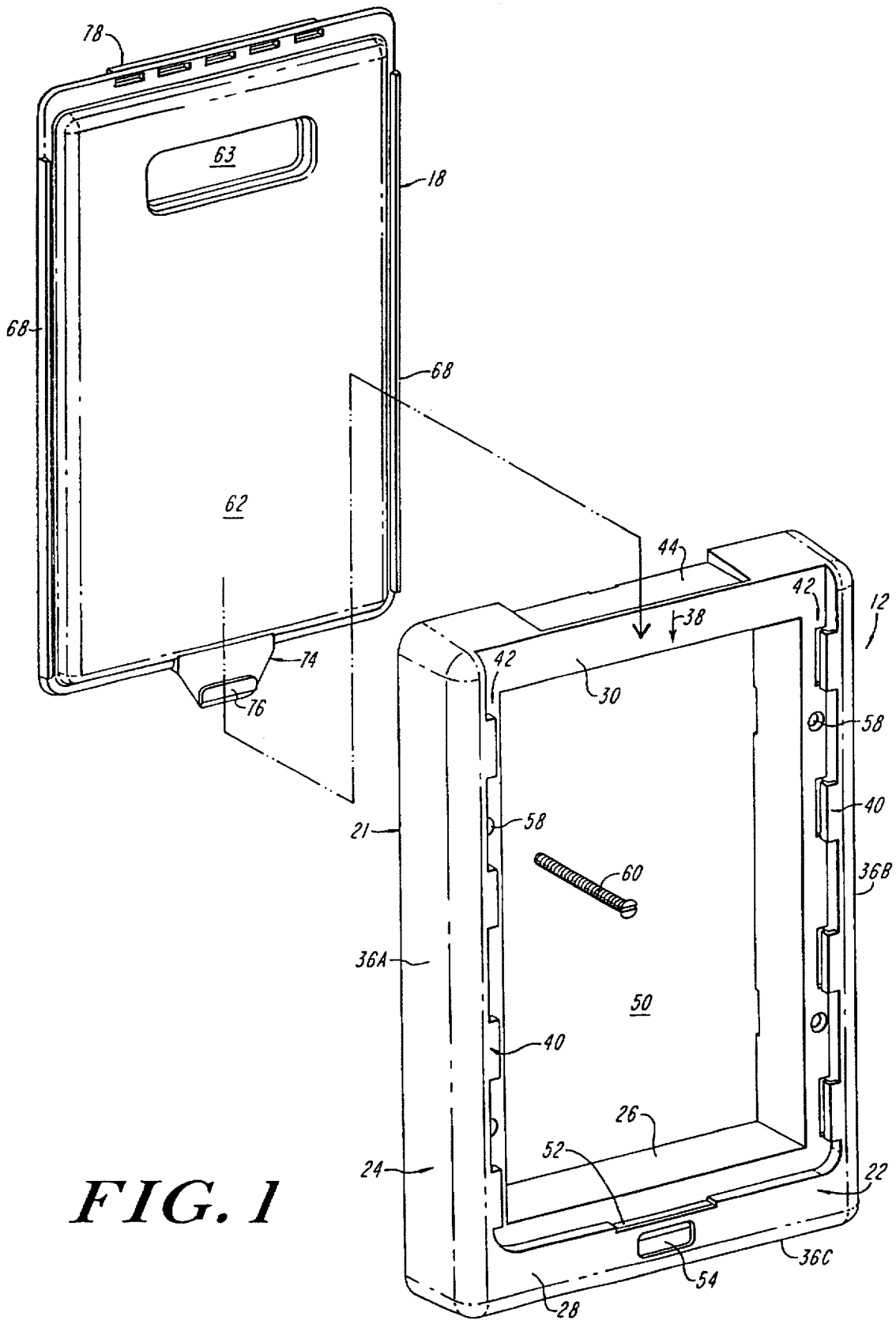
FIG. 1 is an unassembled perspective view of a security cover and a front external frame member of the pet door assembly of the present invention.

As shown in FIGS. 1 through 11, the pet door assembly 10 of the present invention includes a front external frame member 12, an inner frame 14, a rear external frame member 16, a security cover 18, and a door flap 20. The illustrated pet door assembly 10 is designed to seat within a hole formed in a wall, e.g., a door of an enclosure, such as a house. The security cover 18 of the present invention seats within a channel formed in the front frame member 12. The cover 18 and the channel cooperate to secure the security cover 18 to the pet door assembly 10 and to prevent the cover from being dislodged from the door when subjected to a force applied normal to the cover door. Additionally, the door flap 20 is mounted to the inner frame 14 to center the door flap within the pet door assembly 10, rather than being mounted to one of the external frame members 12, 16.

Figure 2A:
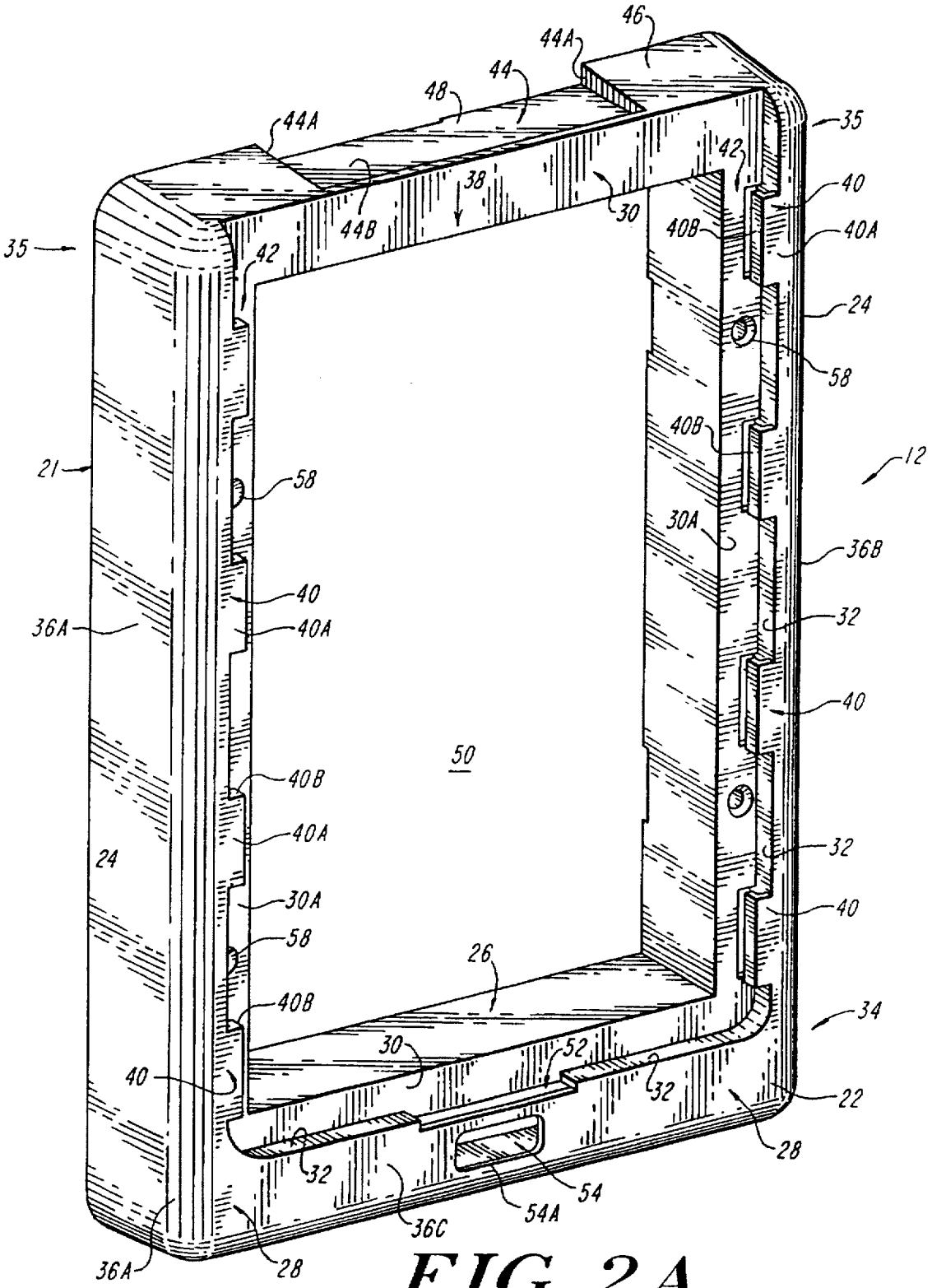
FIG. 2A is a perspective view of the front external frame member of FIG. 1.
Figure 2B:
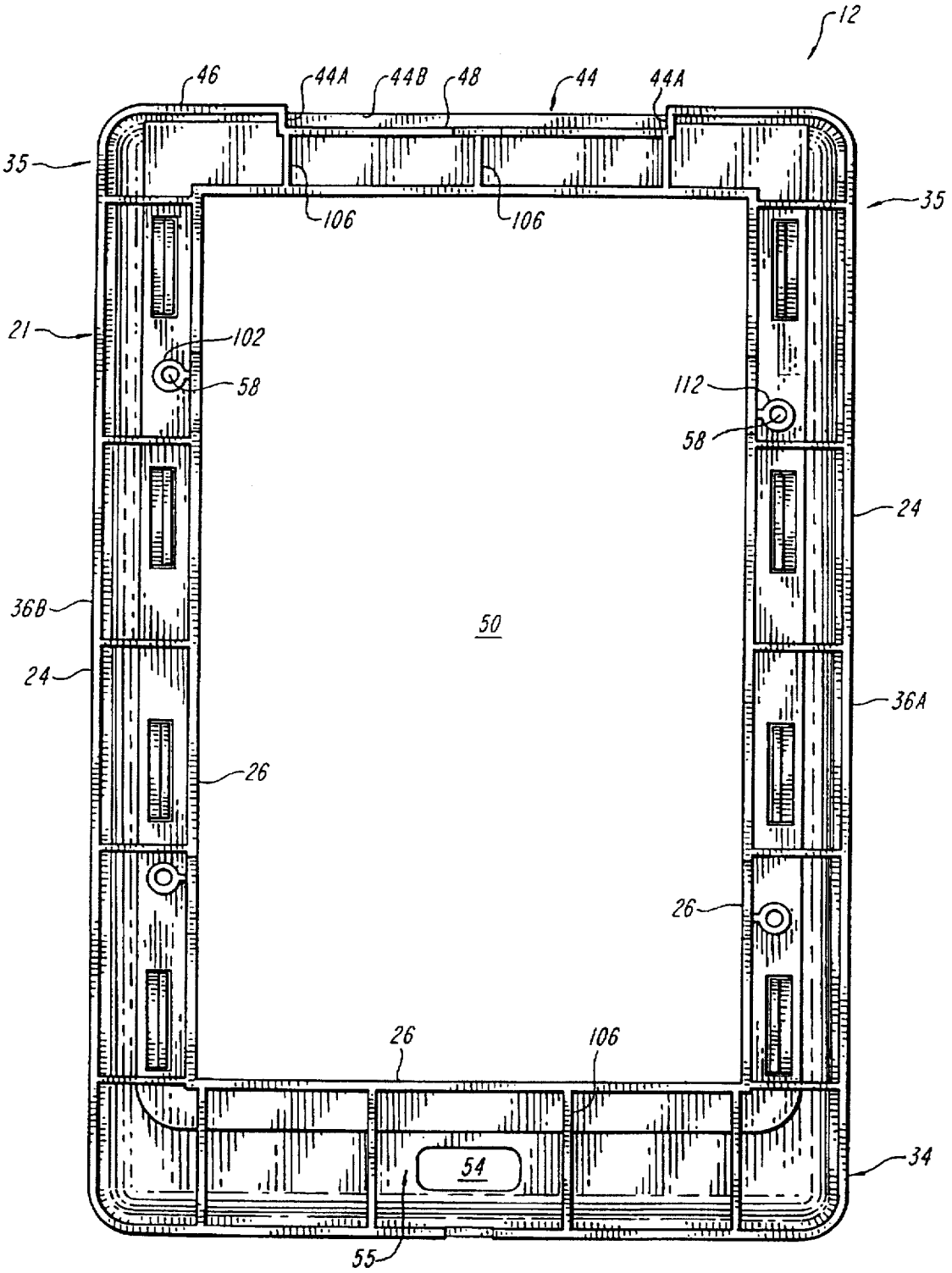
FIG. 2B is a rear view of the front external frame member of FIG. 2A.

Referring to FIGS. 1, 2A and 2B, the front frame member 12 includes a unitary, beveled main body 21 that is sized to seat over the hole formed in the wall of the enclosure. The front external frame member 12 has an exterior wall portion 22 that includes an outer peripheral surface 24 that has substantially rounded edges to reduce the number of sharp contours of the assembly, and a front outer surface 28. The front external frame 12 also has an inner peripheral surface 26 that defines, in conjunction with the inner frame 14 and rear external frame member 16, a pet passageway 50.

The front frame member 12 also includes a stepped inner front surface 30 that is connected to the front outer surface 28 by a wall portion 32. The stepped inner surface 30 preferably surrounds the pet passageway 50, and the wall portion 32 preferably extends about three sides of this passageway. Specifically, the wall portion 32 preferably extends along the bottom portion 34 and along the vertical sides 36A, 36B of the frame member 12. The outer front surface 28 includes a pair of parallel vertical sides 36A and 36B that are orthogonal to a horizontal bottom side 36C. The illustrated upper portion 35 of the front frame member 12 is free of the wall portion 32 and is substantially open to form a cover receiving slot 38. Further, the frame 12 includes a recessed portion 44 formed in the frame top surface 46 that extends between and connects the vertical sides 36A and 36B. The recess 44 includes a pair of parallel lateral walls 44A and a horizontal transverse wall 44B formed along the front-most portion of the frame that spans between and connects the lateral walls 44A. The recess 44 further includes a floor 48 that is slanted at a selected angle relative to the frame top 35, and which slopes away from the transverse wall 44B and the frame front surface 28.

Figure 4:
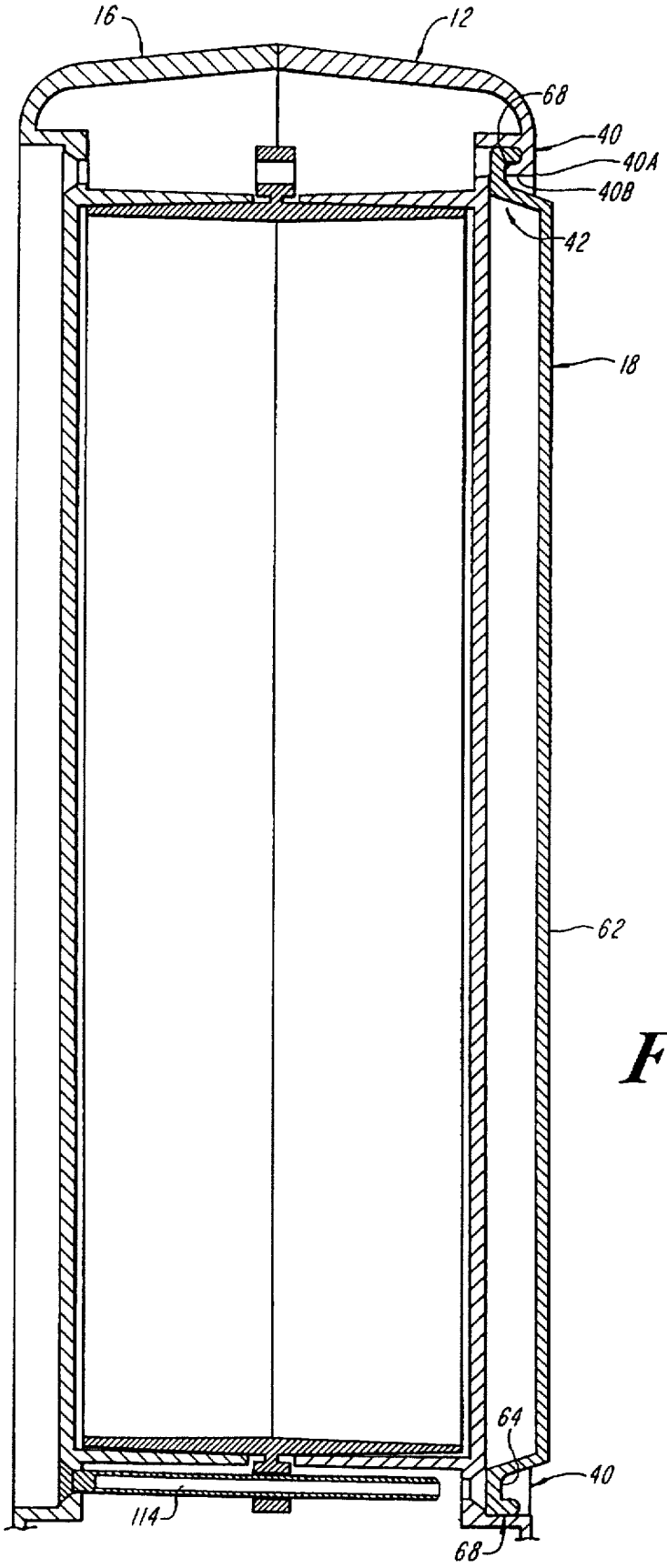
FIG. 4 is a cross-sectional view of the pet door of the invention illustrating the mating interlocking relationship of the external frame member and the security cover of FIG. 1.

The front external frame 12 has a series of integral bosses or channel members 40 that are axially spaced along the vertical sides 36A, 36B of the frame 12. The bosses 40 formed along each vertical side define a pair of channels 42 that seat the security cover 18. As best shown in FIGS. 2A and 4, the bosses 40 include a front wall portion 40A that extends inwardly along the stepped inner surface 30 of the frame towards the pet passageway 50. The front wall portion 40A of the boss terminates in a transverse base portion 40B that is inwardly spaced from the wall portion 32 and that extends inwardly towards the stepped inner surface 30. The space between the base 40B of the boss 40 and the frame wall portion 32 forms the channels 42. The channels 42 retain the security cover 18 when placed therein, as described in further detail below. Those of ordinary skill will readily recognize that the bosses 40 formed along each vertical side 36A and 36B can be joined to form a continuous rail structure that extends along each vertical side. Other permutations of this design are readily recognizable by the ordinarily skilled artisan. Furthermore, the bosses 40 can include other designs that provide for an interlocking fit between the bosses and the security cover, and which are readily recognizable by one of ordinary skill.

With further reference to FIGS. 1, 2A and 2B, a slot 52 is formed along the bottom horizontal side of the wall portion 32, and which opens onto an internal hollow chamber 55, FIG. 2B. The frame bottom side portion 36C further includes an elongate opening 54 formed in the outer front surface 28, below the slot 52. The opening 54 also opens onto the internal chamber 55 and communicates with the slot 52. The opening 54 can have any suitable shape and preferably has a shape complementary to the shape of surface feature 76 of the illustrated security cover 18.

Each of the vertical side portions 30A, 30A of the stepped inner surface 30 includes a series of fastener-receiving apertures 58 that are vertically spaced apart along each vertical side. The apertures 58 are preferably formed at positions that are staggered with respect to the apertures 58 formed in the opposing vertical side. For example, the apertures 58 formed along the leftmost vertical side 30A in FIG. 2A are located at horizontal positions vertically below the apertures 58 formed along the rightmost vertical side 30A. FIG. 2B clearly illustrates the spaced, staggered relationship between the apertures formed on each vertical side of the frame. The aperture tubular housings 112 on vertical side 36B are located vertically above the housings 112 formed on the vertical side 36A. The illustrated fastener-receiving apertures 58 are preferably sized to seat a mechanical fastener, such as the illustrated self-threading screw 60.

The front frame 12 further includes a plurality of structural stiffeners 106 disposed about the pet passageway 50 and which extend between the inner peripheral surface 26 and the outer peripheral surface 24. The stiffeners 106 provide mechanical support to the frame element to prevent warping and breaches in the structural integrity of the frame component. As illustrated, the stiffeners are spaced about the frame element on all four sides to provide uniform support and stiffening throughout.

Referring to FIGS. 1, 3A, 3B and 4, the security cover 18 includes a main body having a raised middle portion 62 and a stepped outer peripheral surface 64 that is connected thereto by a substantially rounded wall portion 66. The wall portion 66 has substantially rounded features to reduce the number of sharp contours of the security cover 18. The security cover further includes a pair of flanges or rails 68 formed along the vertical sides 80A, 80B of the cover. The rails 68 protrude outwardly from the peripheral surface 64 and vertically extend between the top portion 70 and the bottom portion 72 of the cover. The dimensions of the cover 18 are such that it can seat within the cover-receiving slot 38 and within the channels 42 formed in the front external frame 12.

The illustrated cover 18 further includes a tab-like protrusion 74 that is integrally formed with the cover bottom portion 72, and which extends downwardly and outwardly therefrom. The protrusion 74 further includes a surface feature 76, e.g., a raised tab, formed on a front surface 74A. The tab-like protrusion 74 has a corresponding size and shape that enables it to seat within the slot 52 formed in the wall portion 32 of the frame 12. Additionally, the surface feature 76 has a shape complementary to the opening 54 and is sized to seat therein and to engage the periphery 54A of the opening 54, FIG. 2A. The raised middle portion 62 further includes a recess 63 that is sized to accommodate the finger tips of a user. Hence, the recess 63 allows the user to easily manipulate the position of the cover either during insertion or removal of the cover from the channels 42.

Figure 3A:
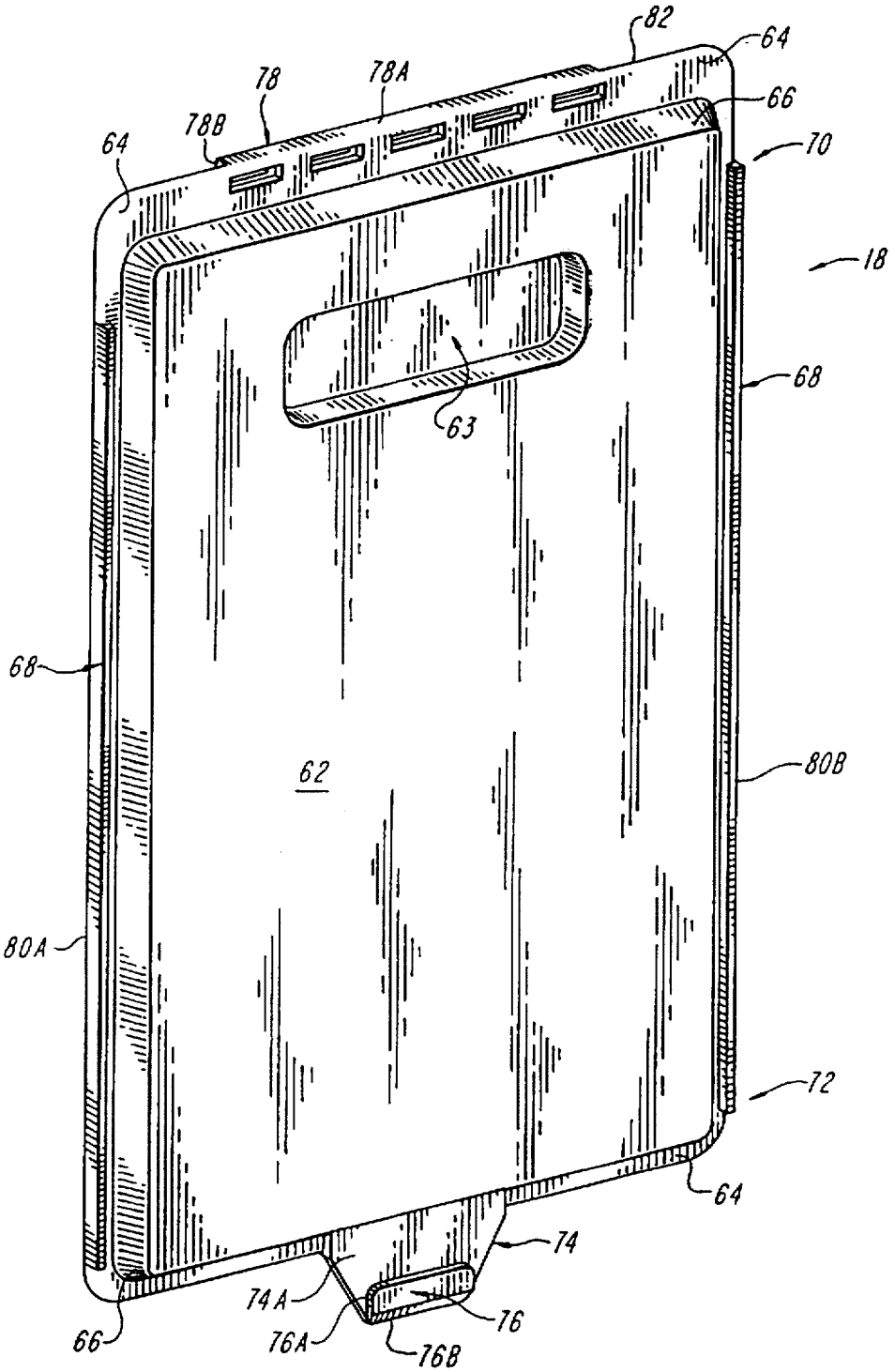
FIG. 3A is a perspective view of the security cover of FIG. 1.
Figure 3B:
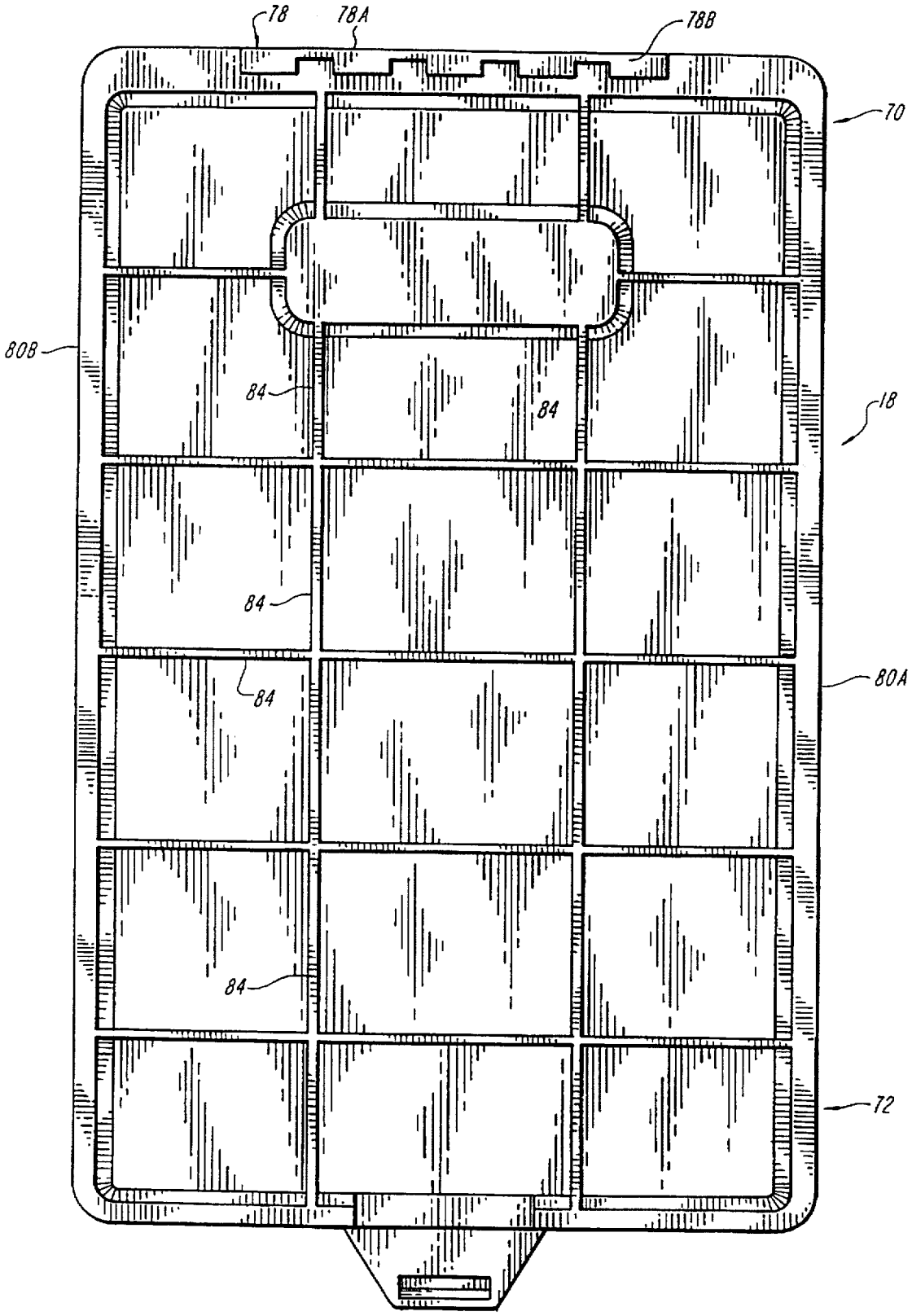
FIG. 3B is a rear view of the security cover of FIG. 3A.

Referring to FIGS. 3A and 3B, the top portion 70 of the security cover 18 has a latching rail 78 formed along a top edge 82 of the peripheral surface 64. The latching rail 78 includes a base portion 78A that extends horizontally outward from the top edge 82 and a latching portion 78B that is integrally formed with and transverse to the base portion 78A. The latching portion 78B is outwardly spaced from the back side of the cover surface 64 to form a receiving cavity and extends downwardly from the base portion 78A a selected distance towards the bottom portion 72 of the cover 18. The latching rail 78 preferably engages the transverse lateral wall 44B of the recessed portion 44 formed in the top 35 of the front frame member 12 when the cover is disposed within the channels 42.

As shown in FIG. 3B, the cover 18 includes a plurality of structural stiffeners 84 that formed along the backside or rear of the cover in a spaced apart and interlocking manner. The illustrated stiffeners 84 are similar in function and form to the stiffeners 106 of the front external frame 12.

Those of ordinary skill will recognize that the illustrated security cover 18 can be secured to the frame 12 without employing the tab-like protrusion 74 and/or the top latching rail 78. Thus, an alternate embodiment of the illustrated security cover 18 includes only the rails 68 formed along the vertical edges 80A, 80B of the cover, or includes the rails 68 and either the protrusion 74 or the latching rail 78. Those of ordinary skill will also recognize that the shape and configuration of the cover body can be changed without detracting from the use and operability of the cover.

In operation, the bottom portion 72 of the cover 18 can be inserted into the cover-receiving slot 38 of the front external frame 12 as follows. The vertical rails 68 of the cover are aligned with bosses 40, and the cover is inserted into the channels 42 by sliding the cover down within the channels, as indicated by the solid arrow in FIG. 1. The cover rails 68 are slidingly engageable with the bosses 40, which serve to retain the rails 68 within the channel 42 during this sliding movement, FIG. 4. Specifically, the bosses 40 substantially surround and engage the rails 68 to retain the rails within the channels 42. The tab-like protrusion 74 is then inserted through the slot 52 formed along the cover bottom and into the hollow chamber 55. Upon the continued downward movement of the cover, the surface feature 76 is forced into the hollow interior portion of the frame, and then snaps into the opening 54. In this position, the outer surface 76A of the surface feature 76 matingly engages the periphery 54A of the opening 54. Furthermore, when the surface feature 76 is fully seated within the opening, the top surface 76B of the surface feature is exposed to the interior of the enclosure.

When the cover 18 is disposed in its downward-most position, e.g., when the surface feature 76 seats within opening 54, the latching rail 78 formed along the cover top edge 82 hooks over and engages the lateral wall 44B of the frame recess 44 by seating the wall 44B within the receiving cavity. The mating engagement of the rails 68 of the cover with the bosses 40, the snap-fit engagement of the raised surface feature 76 with the opening 54, and the latching of the top rail 78 with the frame 12 secure the cover 18 within the channel 42 and to the pet door assembly 10. This locking configuration prevents a force applied normal to the cover from dislodging it from the pet door. Consequently, the security cover 18 prevents intruders from purposely dislodging the security cover from the door, and thus from gaining access to the enclosure.

The cover can be removed from the pet door assembly 10, and particularly from the front external frame 12, by depressing the exposed top 76B of the surface feature 74 until the surface feature 76 disengages from the slot periphery 54A, and by lifting the cover 18 upwards, so that the surface feature 76 clears the opening 54 and is forced upwardly through the slot 52. The cover 18 is then forced upwards until the latching rails 78 disengage from the bosses of the frame 12.

Figure 3C:
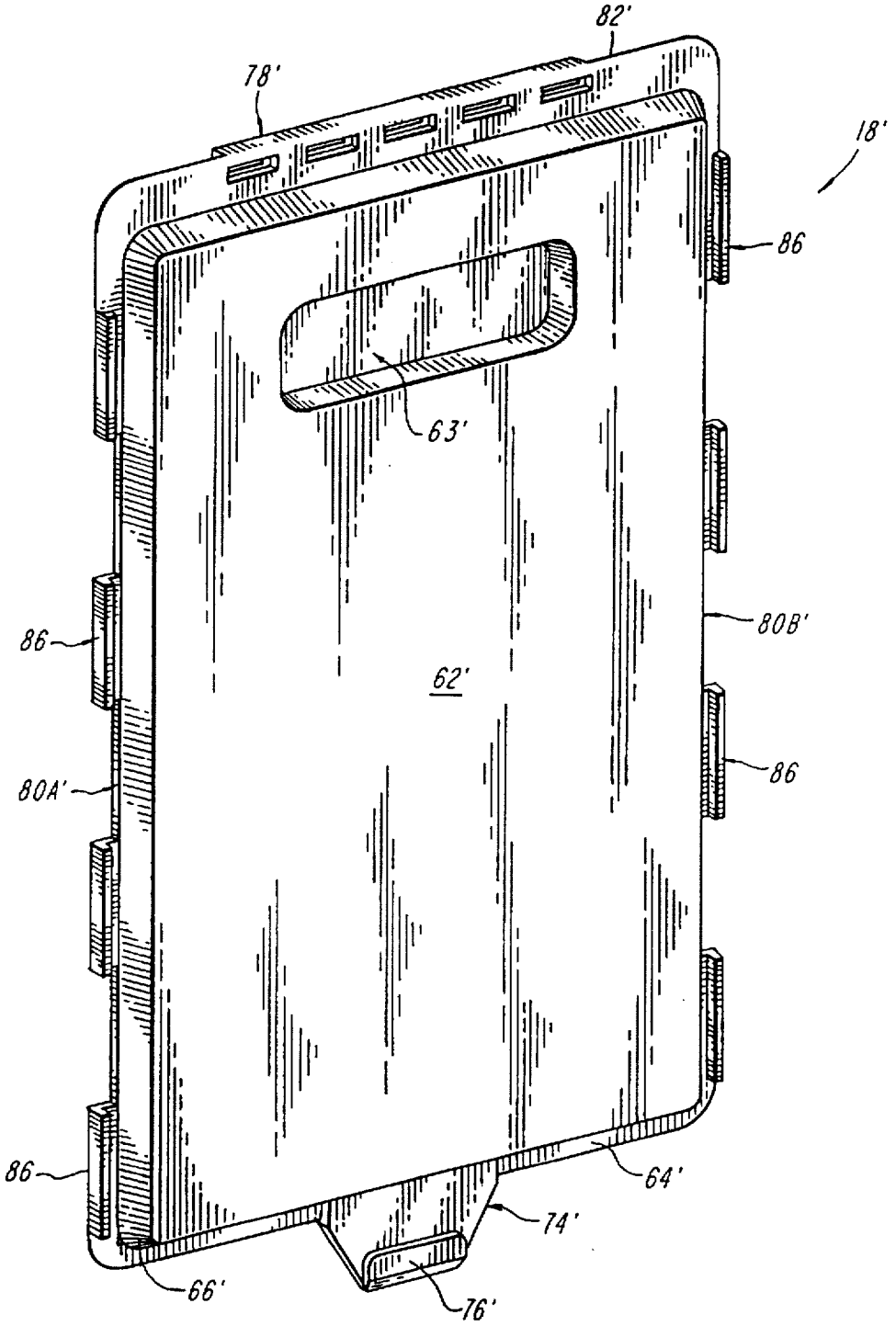
FIG. 3C is an alternative embodiment of the security cover of FIG. 3A.

FIG. 3C illustrates a second embodiment of the security cover 18' of the invention. Like cover parts are designated throughout the views with like reference numerals plus a superscript prime. The security cover 18' includes a raised interior portion 62' and a stepped peripheral surface 64' that is connected to the raised interior by a rounded wall portion 66'. The interior portion 62' preferably extends along the top and bottom horizontal sides of the cover 18' and includes a recess 63'. Each vertical edge 80A' and 80B' of the cover 18' includes a plurality of channel interlocking members 86 that are axially spaced along the vertical edges. The illustrated interlocking members 86 are similar in configuration to the rails 68 of FIG. 3A. The bottom portion 72' of the cover 18' further includes a tab-like protrusion 74' having a raised surface feature 76', and the top portion 70' includes a latching rail 78' formed along the top edge 82'. The protrusion 74' and the latching rail 78' are also similar in configuration to those shown in FIG. 3A.

The cover 18' can be secured to the pet door assembly 10 in a manner similar to that described above. Alternatively, the cover 18' can be secured to the frame 12 by simply aligning the channel interlocking members 86 with the bosses 40, and by inserting the tab portion 74' into the slot 52. The cover is then forced downward until the surface feature 76 of the tab 74 seats within the aperture 54, and the interlocking members engage the bosses 40. Advantageously, this avoids having to insert the cover bottom portion into the channels 42 at the top of the frame.

The cover is removed from the frame 12, and from the channels 42, by forcing the cover upwardly a selected distance until the tab-like protrusion 74' disengages from the slot 52 and the interlocking members 86 disengage from the bosses 40. Upon disengagement, the security cover can be removed by pulling the cover 18' outwardly and away from the frame member 12 rather than by lifting the cover 18' upwardly until the last interlocking member 86, e.g., the interlocking members closest to the bottom 72', disengages from the top-most boss 40.

Figure 3D:
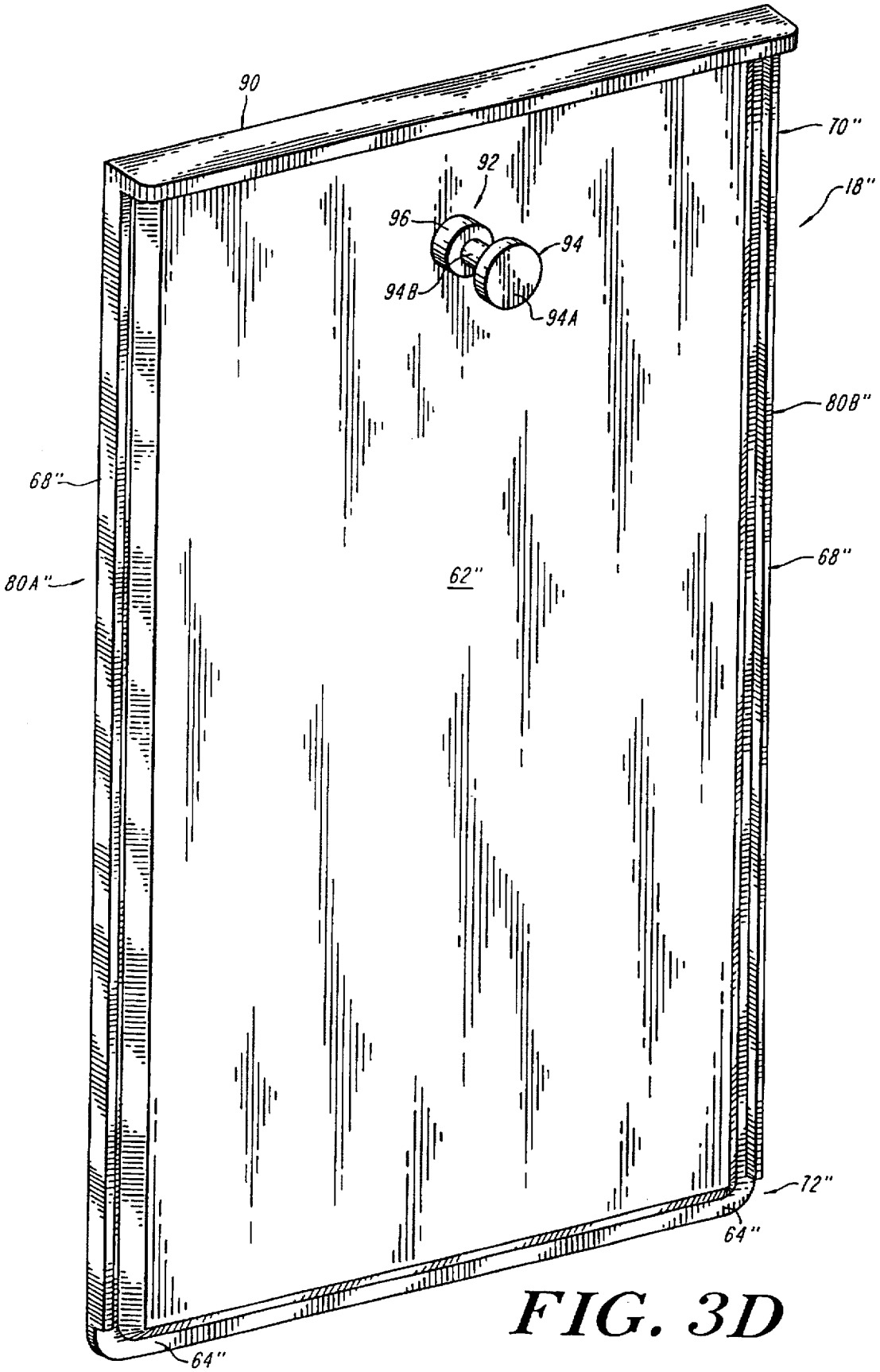
FIG. 3D is another alternative embodiment of the security cover of FIG. 3A.

FIG. 3D illustrates still another embodiment of the security cover 18" of the present invention. Like parts are designated throughout the views with like reference numerals plus a double script prime. The illustrated security cover 18" includes a raised interior portion 62" and a stepped outer peripheral surface 64". The vertical edges 80A" and 80B" of the cover 18" include a rail 68" that extends between the top portion 70" and the bottom portion 72" of the cover. The rail 68" is similar in configuration to that of FIG. 3.

The illustrated cover 18" further includes a ledge portion 90 that extends outwardly and away from the top horizontal side of the outer peripheral surface 64", and which overhangs at least part of the raised interior portion of the cover 18". A plunger pin assembly 92 is mounted on the raised internal portion of the cover 62". The pin assembly 92 includes a movable button 94 that has a pin head 94A and a shaft 94B that extends outwardly from the head. The shaft 94B preferably seats within a tubular housing 96 that is integrally formed on the surface 62" of the cover 18". The tubular housing preferably seats a resilient spring member (not shown). In the illustrated assembled form, the shaft 94B extends within the housing 96 and the spring member is disposed about the pin shaft 94B, such that the spring is located between the inner surface of the housing 96 and the outer surface of the shaft 94B. The shaft portion 94B is slidably movable within the tubular housing, and thus defines a plunger.

The pin shaft 94B is alternately disposable between a first normally protruding position and a second non-protruding position by pulling the button 94 via pin head 94A outwardly and away from the tubular housing 96. In the first position, the end portion of the shaft 94B preferably extends beyond the rear side of the cover 18". In the second position, the end portion of the shaft 94B is disposed within the housing 96. The resilient spring member functions to return the shaft 94B to its normally protruding position upon cessation of the applied force to the movable button 94. The illustrated plunger pin assembly 92 is of conventional design and is readily known to those of ordinary skill.

The illustrated security cover 18" is mounted to the front frame member 12 in the manner described above in relation to the embodiment of FIG. 3A. Specifically, the rails 68" are inserted into the drop-in channels 42 at the top of the front external frame 12. The cover 18" is then slid downwardly such that the rails 68" travel within the channels towards the bottom portion 34 of the frame. The shaft 94B of the plunger pin 92 which normally extends outwardly from the reverse side of the cover, is forced into the second non-protruding position by contact with the frame 12 during this downward movement. The shaft 94B remains in this position until the force applied by the frame to the shaft is removed. Typically this occurs by providing an appropriate aperture formed in the top portion 35 of the front frame member 12. The aperture is preferably sized to seat the shaft 94B of the pin assembly 92. The pin shaft 94B is biased into the normally protruding position and into the aperture by the resilient spring member when the shaft is aligned with the aperture. The plunger pin assembly 92 thus functions as a redundant securing mechanism, in addition to the rails 68", which secures the security cover to the pet door assembly 10.

The security cover 18" can be removed from the pet door assembly 10 by pressing outwardly on the push button 94 to remove the shaft from its mating aperture. The security cover 18" can then be forced upwardly by grabbing the ledge portion 90. This upward movement slidingly disengages the rails 68" from the boss members 40.

FIGS. 5 through 10 illustrate the remaining components of the pet door assembly 10 of the present invention. The components include the inner frame 14, the door flap 20, and the rear external frame member 16.

Figure 8:
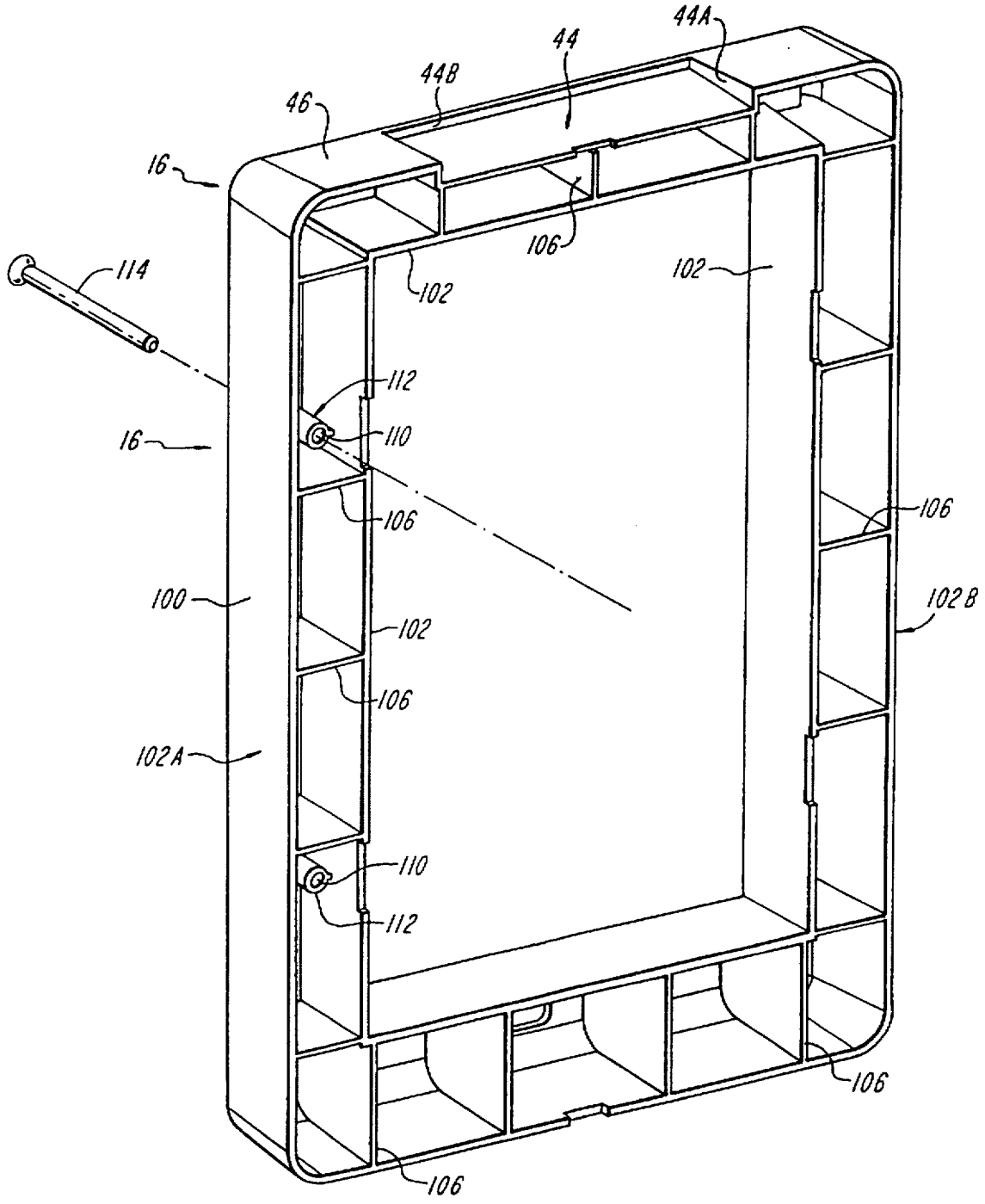
FIG. 8 is a perspective view of the rear side of the other external frame member of the pet door assembly of the present invention.

The rear external frame member 16 of FIG. 8 is preferably identical to the front frame member 12 illustrated in FIGS. 1, 2A and 2B. The illustrated rear external frame member 16 thus comprises a unitary molded frame member that has a rounded outer peripheral surface 100 and an inwardly spaced inner peripheral surface 102 that forms part of the pet passageway 50. The inner peripheral surface 102 is inwardly spaced from the outer peripheral surface 100 and is connected thereto by a plurality of structural stiffeners 106 formed about the periphery of the frame member 16.

The vertical sides 108A, 108B of the rear frame 16 include a pair of fastener-receiving apertures 110 that are spaced apart vertically along the height of the frame 16. The apertures 110 are preferably enclosed by a cylindrical housing 112 that extends between the front and back sides of the frame member 16. The fastener-receiving apertures 110 preferably seat mechanical securing fasteners, such as the self-threading screw 114 having an associated spin nut 190, FIG. 6.

The fastener-receiving apertures 110 formed along each vertical side are at locations different from the fastener-receiving apertures 58 of the front frame member 12. According to one practice, and with particular reference to FIG. 2B, the fastener-receiving apertures 110 of the vertical side 108A are formed at spatial locations vertically above the apertures 110 formed along vertical side 108B. These apertures 110 are preferably aligned with the apertures 58 formed in the front external frame member 12 as follows. The apertures 110 of the rear frame member 16 formed along vertical side 108A are disposed above and are vertically aligned with the fastener-receiving apertures 58 formed along vertical side 36A of the front frame 12. Conversely, the apertures 110 formed along vertical side 108B of the rear frame 16 are disposed vertically below and are vertically aligned with the apertures 58 formed along vertical side 36B of the front frame 12. The vertical alignment of the fastener-receiving apertures of the front and rear frame members 12, 16 correspond to the vertical alignment of the apertures 184, 186 formed in the fastener bracket 180 of the inner frame 14 of the invention, as shown in FIGS. 6 and 10 and as described in further detail below.

Figure 5:
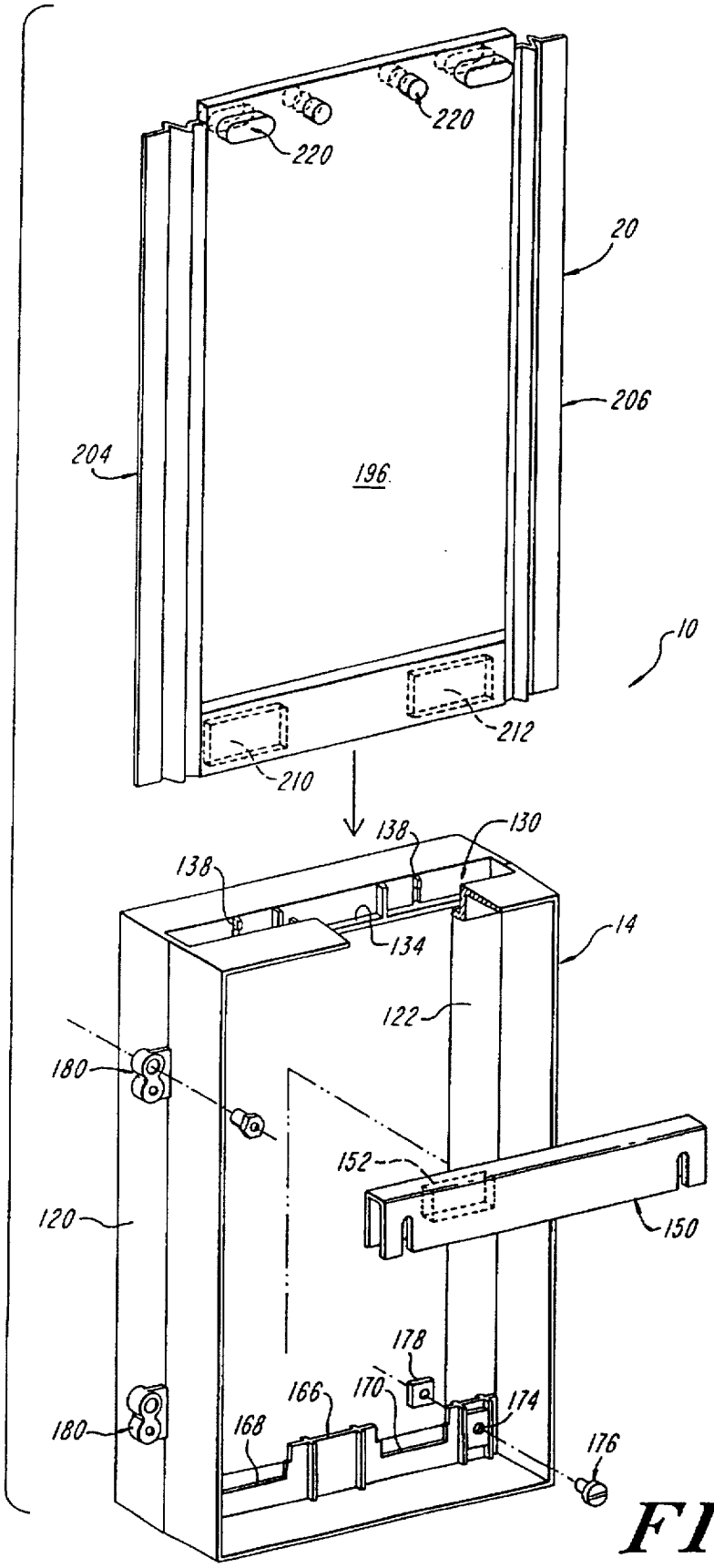
FIG. 5 is a perspective unassembled view of an inner frame and a door flap of the pet door assembly of the present invention.
Figure 6:
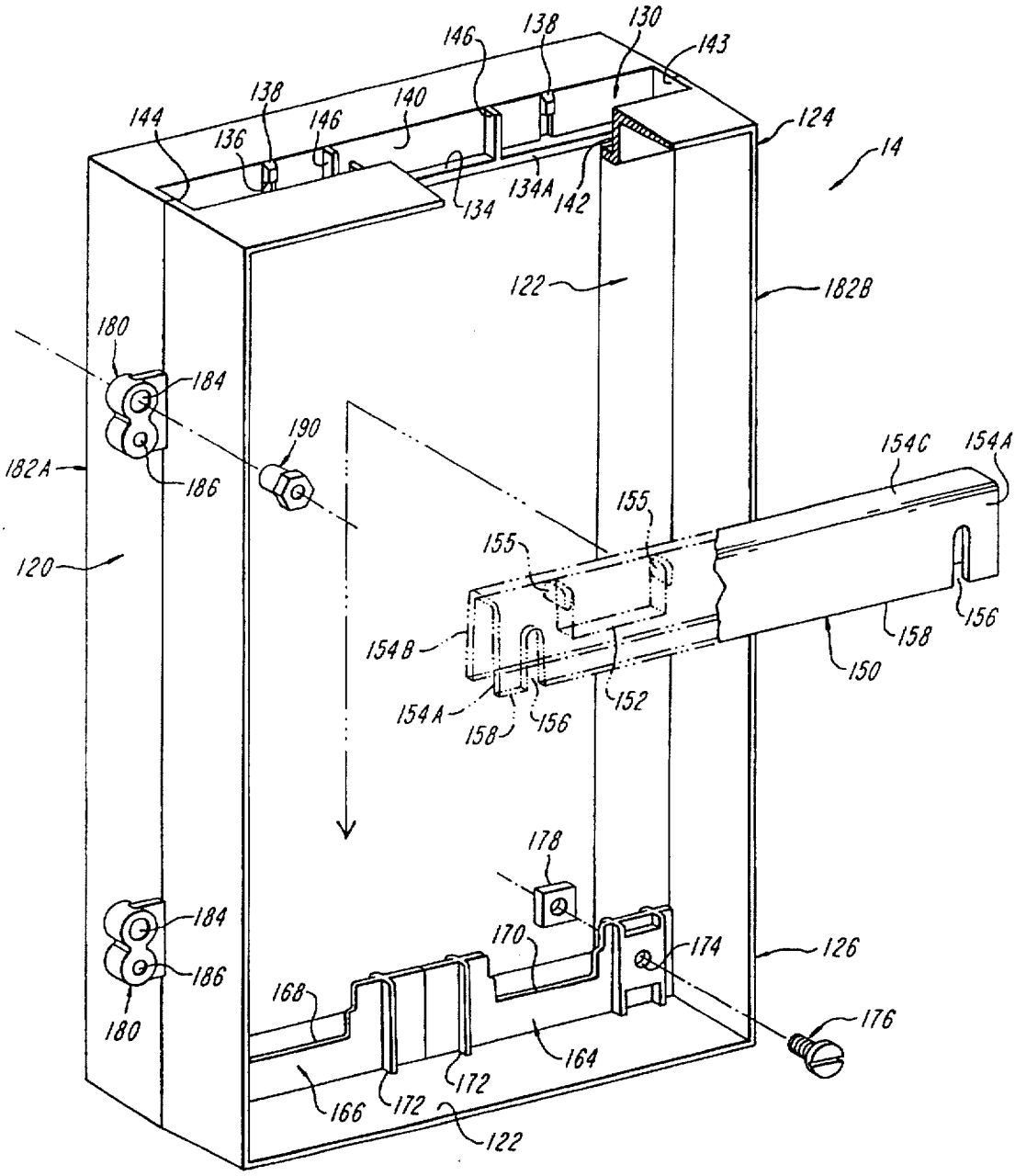
FIG. 6 is a perspective view of the inner frame and door sill of FIG. 5, with the inner frame partly broken away to show features of the flap-receiving channel of the invention.
Figure 9:
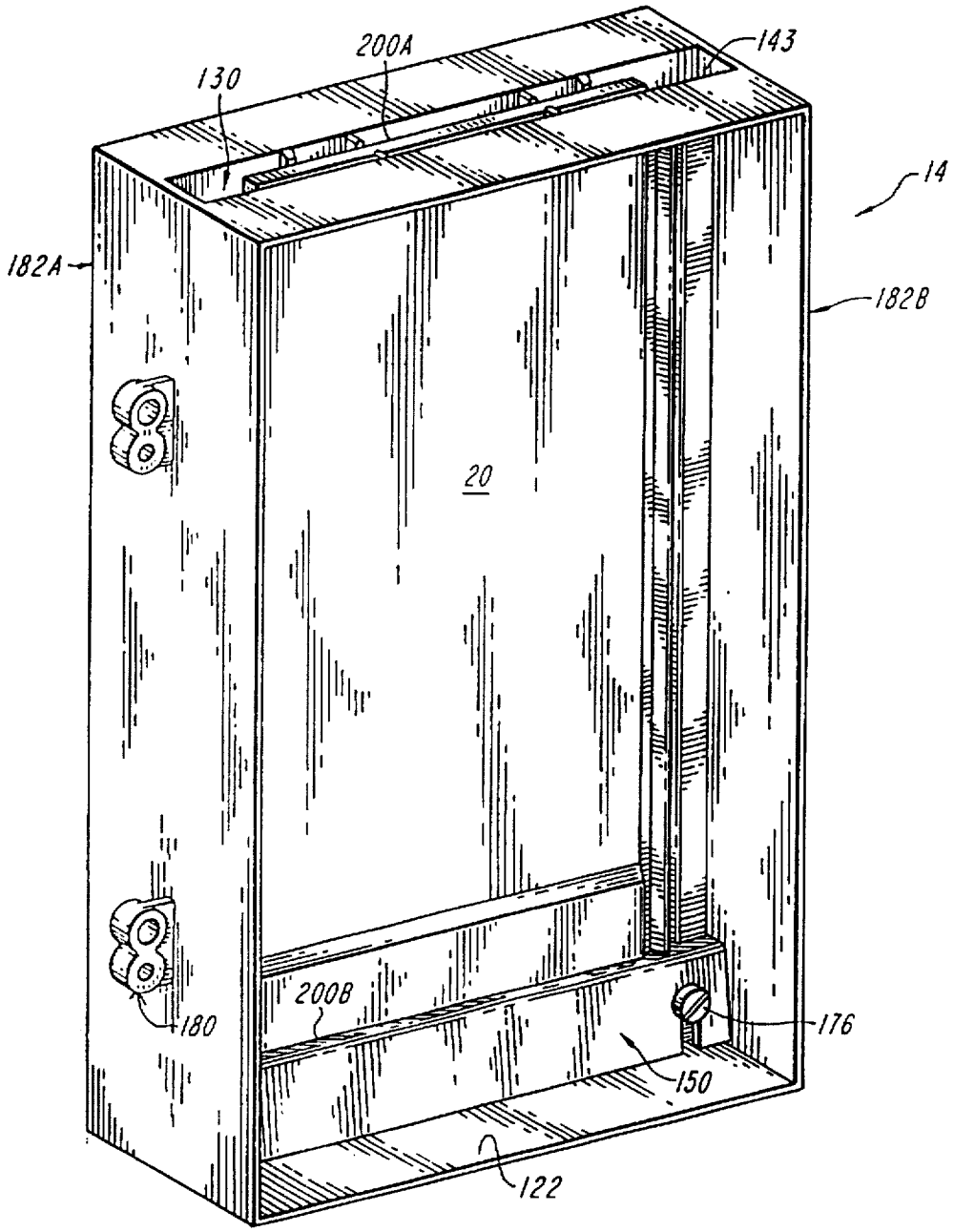
FIG. 9 is a perspective view of the assembled pet door showing the mating relationship between the door flap and the inner frame.

FIGS. 5, 6, 9 and 10 illustrate the inner frame 14 of the present invention. The inner frame 14 has a substantially rectangular main body having an outer peripheral surface 120 and an inner peripheral surface 122. The main body can comprise a unitary, molded rectangular-shaped frame member or can comprise a pair of integrable and connectable half portions. With particular reference to FIGS. 6 and 9, the inner frame 14 includes a channel 130 formed in the top portion 124 of the inner frame 14. The channel 130 includes a pair of elongate, parallel vertical walls 140 and 142, and a pair of transverse walls 143 and 144 that span between and connect the vertical walls 140, 142. A bottom ledge portion 134 is integrally formed with the vertical walls 140, 142 and extends along the length of the channel between the transverse walls 143, 144. The front edges 134A of the ledge portions 134 are spaced apart by a selected distance to allow the flap 20 to pass therethrough. According to a preferred embodiment, this distance is greater than the thickness of the main body 196 of the flap 20. A plurality of structural stiffeners 146 are integrally formed with the vertical walls 140, 142 and the ledge portions 134, and preferably extend along the height of the vertical walls.

Figure 11:
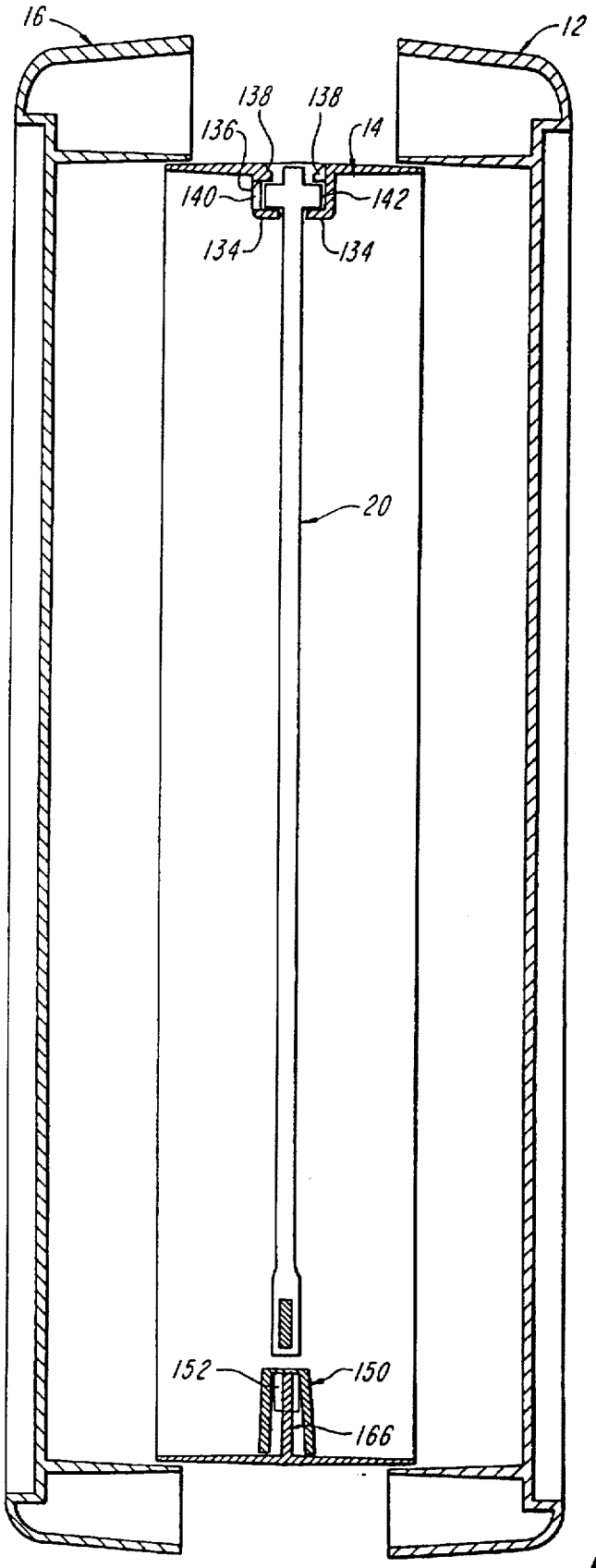
FIG. 11 is a side cross-sectional view of the assembled pet door showing the mating relationship between the door flap, the spacer frame and the frame members.

Referring to FIGS. 6 and 11, the channel walls 140, 142 further include surface features 138, e.g., tab-like protrusions, that extend outwardly from the wall surfaces a selected distance above the ledge 34. This distance is preferably greater than the height of the surface features 220 of the flap 20. The protrusions help retain the flap 20 within the channel 130 by preventing unwanted upward movement of the flap, as described in further detail below.

Figure 10:
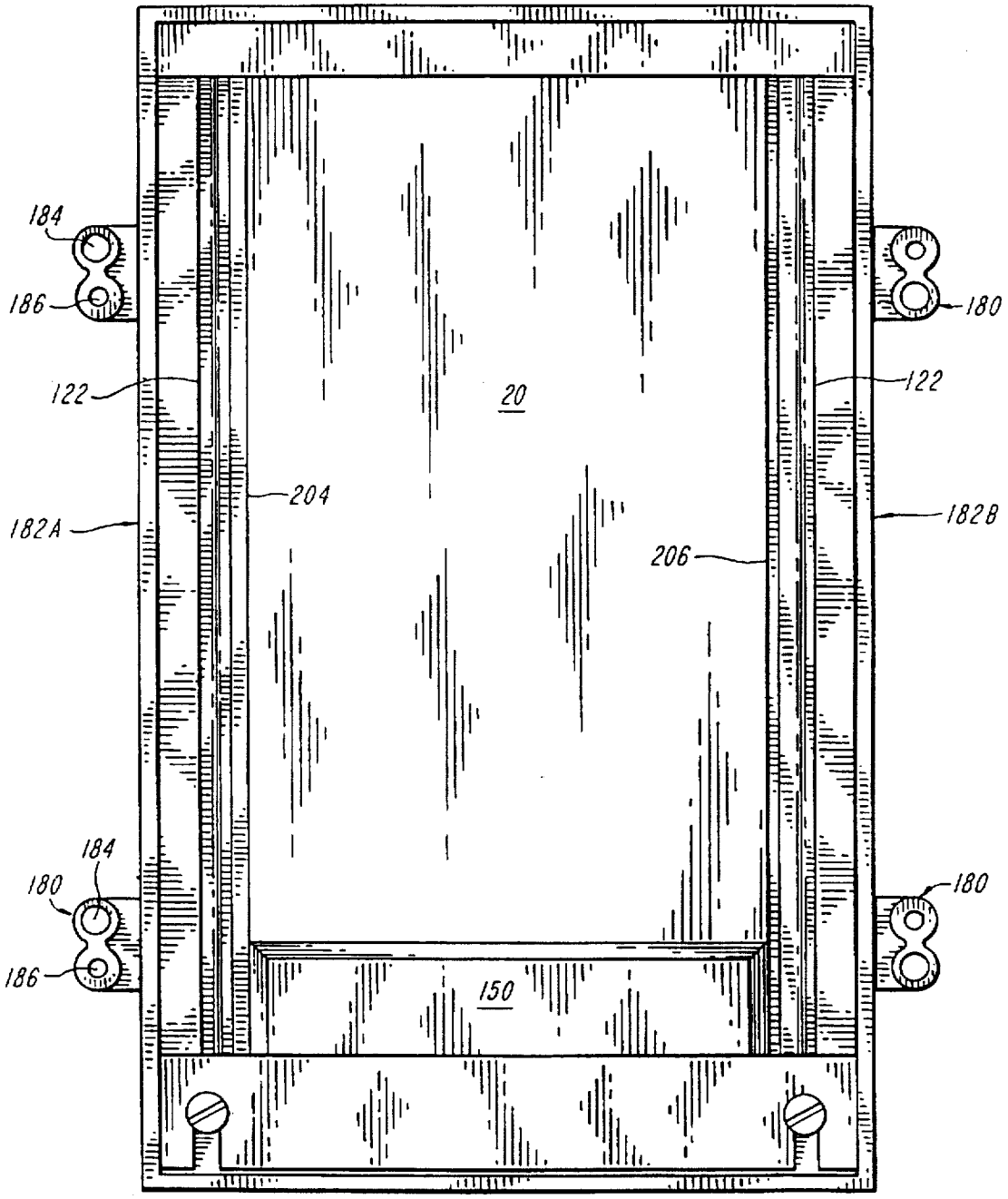
FIG. 10 is a rear view of the assembled pet door of FIG. 9 illustrating the alternating relationship of the fastener bracket apertures.

With reference to FIGS. 6, 9 and 10, the door sill 150 mounts on the bottom portion 126 of the inner frame 14 by way of sill mounting structure 164. The door sill 150 includes a main body having elongate spaced apart ends 154A and 154B and a top wall portion 154C that connects the ends 154A, 154B. A pair of fastener slots 156 are formed on opposite ends of each end portion 154A, 154B. The fastener slots 156 on portion 154A are preferably in registration with the slots 156 on end portion 154B, such that a fastener element, such as screw 176, can easily extend between both sides when mounted within the slots.

The illustrated door sill 150 preferably mounts a pair of magnets 152 which are disposed at opposite ends of the sill. The magnets 152 are preferably mounted to the underside of the door sill 150 between a pair of pressure tabs 155 in a pressure fit configuration.

The illustrated sill mounting structure 164 includes a wall portion 166 having front and back sides, and a pair of cutouts 168 and 170 that seat the bottom portion of the sill magnets 152 when the door sill 150 is mounted on the mounting structure 164. A set of structural stiffeners 172 are integrally formed with the wall portion 166 and the inner peripheral surface 122 of the inner frame 14. Each end of the wall 166 includes fastener-receiving apertures 174 that extend between the front and back sides thereof. The apertures 174 are configured to seat appropriate mechanical fasteners, such as the illustrated screw 176 and accompanying nut 178. The illustrated door sill 150 and appropriate mounting structure 164 are similar to that described in U.S. Pat. No. 4,651,793 and U.S. Pat. No. 5,287,654, both assigned to the inventor hereof, and which are herein incorporated by reference.

The illustrated door sill 150 is vertically movable and adjustable by way of the slots 156 formed in the sill 150. The vertical position of the sill 150 can be adjusted by way of the adjusting screw 176 mounted in the corresponding slots 156 and fastener aperture 174. The adjusting screw enables the sill 154 to be positioned such that the sill mounted magnets 152 are magnetically attracted to correspondingly mounted magnets 210, 212 in the door flap 20, as described in further detail below. The screw 176 can be tightened to secure the movable door sill 150 at the proper vertical position, which is preferably the position where the door sill is mounted as close as possible to the bottom of the flap 20.

Each vertical side of the illustrated inner frame 14 includes a pair of fastener brackets 180 that are vertically spaced apart along the height of the frame. The fastener brackets 180 formed along vertical side 182A include a top fastener aperture 184 and a vertically aligned fastener aperture 186 disposed below the top aperture. The diameter of the aperture 184 is preferably larger than the diameter of aperture 186. The top apertures 184 are configured to seat those portions of fasteners 114 that extend beyond the tubular housing 112 of the rear external frame member 16. A spin nut 190 preferably seats over the portion of the bolt 114 that extends beyond the fastener brackets 180. The vertical side 182B of the inner frame 14 also includes a pair of vertically spaced apart fastener brackets 180 similar to the brackets formed on side 182A, except that the bottom fastener aperture 186 has a diameter larger than the top fastener aperture 184, FIG. 10. The bottom aperture 186 is also configured to seat mechanical fasteners mounted in the rear external frame member 16.

Figure 7:
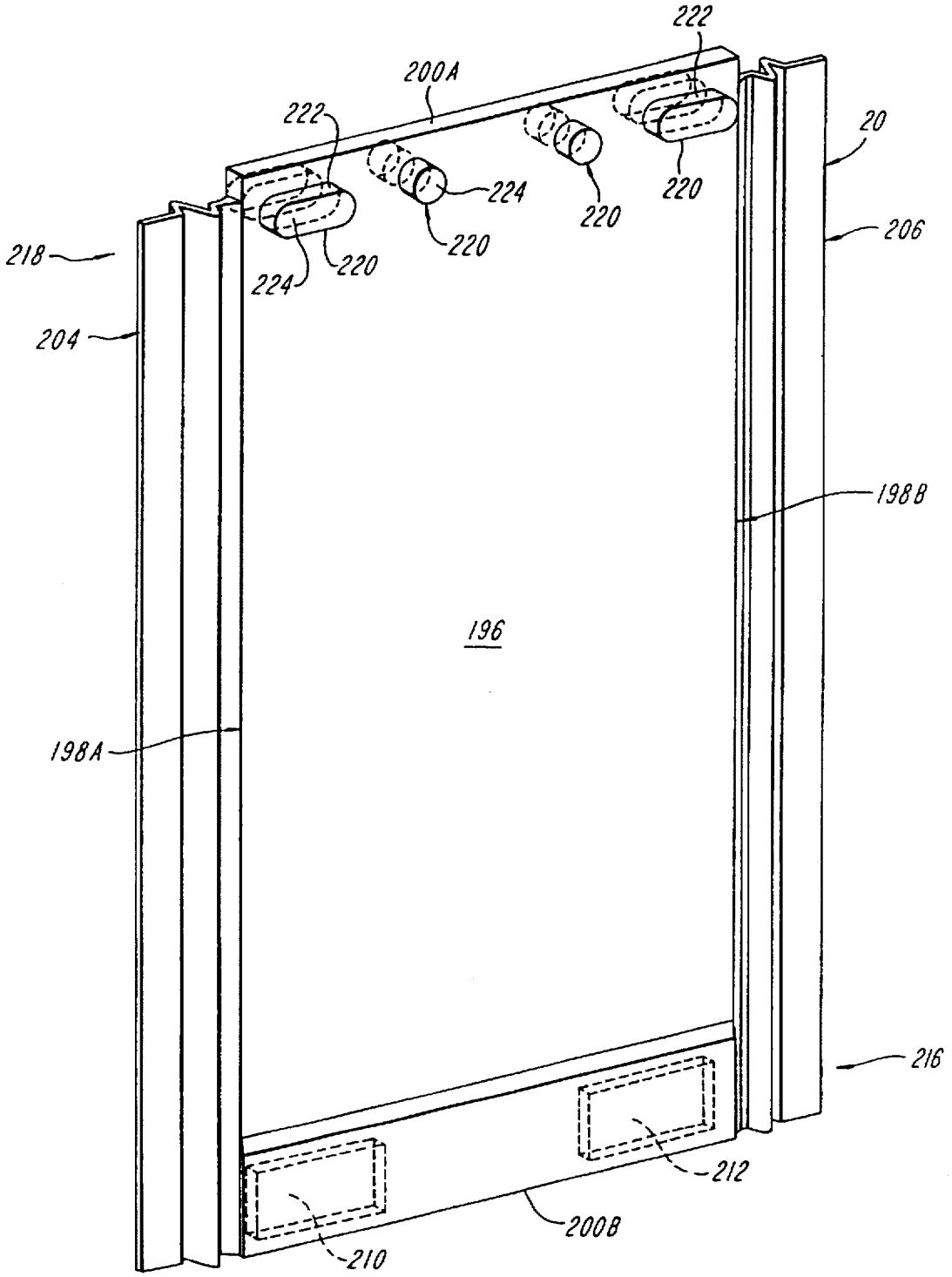
FIG. 7 is a perspective view of the door flap of FIG. 5.

Referring to FIG. 7, the flap 20 includes a main central portion 196 that has a pair of vertical sides 198A, 198B and a pair of horizontal sides **200*a* and 200*b*. The flap 20 also includes web edge portions 204 and 206 that are coupled by known means to the vertical sides 198*a* and 198*b*, respectively. In the illustrated embodiment, the web portions 204, 206** have a generally Z-shaped configuration, similar to those described in U.S. Pat. No. 4,651,793 to the inventor hereof, which is herein incorporated by reference.

The illustrated flap 20 further includes a pair of spaced-apart magnets 210, 212 that are embedded in a bottom portion 216 of the flap along the bottom edge 200B. The flap magnets 210 and 212 cooperate with the magnets 152 of the door sill to arrest the flap 20 in a substantially vertical position, preferably after movement of the flap 40 by a pet passing through the pet door opening. The central portion 196 of the flap is preferably a relatively thick portion that is durable and weather-resistant. The attached web portions 204 and 206 are preferably formed of a durable, weather-resistant, resilient material.

With further reference to FIG. 7, the top portion 218 of the door flap 20 preferably includes a series of surface features 220, e.g., raised detents. The surface features 220 preferably retain the flap within the channel 130 of the inner frame 14, as described in further detail below. Those of ordinary skill will recognize that the surface features can have any suitable shape.

The overall dimensions of the flap 20 are selected to be larger than the dimensions of the pet passageway 50 as defined by the inner peripheral surface of the inner frame 14. Consequently, the resilient web portions 204, 206 of the flap are constrained by the smaller dimensions of the passageway. The resiliency of the web portions allows the flap to vertically hang within the opening, while concomitantly urging the web portions into sealing contact with the vertical sides of the inner peripheral surface 122 of the inner frame. This mating relationship provides for a weather-tight seal between the flap and frame.

With reference to FIGS. 5, 10 and 11, the illustrated flap 20 is mounted to the inner frame 14 by inserting the flap bottom portion 216 into the inner frame channel 130. The flap 20 is slidingly engageable with the inner frame and is vertically dropped within the channel 130. The surface features 220 of the flap first engage the protrusions 138 formed along the vertical walls 140,142 of the channel 130, as denoted by the solid arrow in FIG. 5. The surface features 220 are then forced downward past the protrusions 138 until the flap top portion 218 snaps into the channel 130. In this mounting configuration, the surface features 220 abut the ledge 134 of the channel 130, as shown in FIG. 11. The tab-like protrusions 138 help prevent unwanted vertical movement of the flap by retaining the surface features 220 within the channel 130 during passage of the pet therethrough, thus securing the flap 20 to the frame 14. When the flap 20 is vertically hung within the inner frame 14, the convoluted configuration of the web portions 204, 206 allows the edge portions of the webs to sealingly engage with the vertical side walls of the inner peripheral surface 122, as shown in FIGS. 9 and 10. This provides a good sealing relationship between the flap 20 and spacer frame 14 to separate the interior of the enclosure from the external environment. The magnets 210, 212 bring the movable flap to a vertical halt after passage of the pet through the pet passageway by magnetically interacting with the sill mounted magnets 152. The interaction between the frame and flap mounted magnets prevents the flap from accidentally moving from the vertical position, as by wind, etc.

With reference to FIG. 11, when the top portion 218 of the flap 20 is seated within the channel 130, the top edge portions 222 of the surface features 220 are axially spaced from the bottom 136 of the protrusions 138. Additionally, the front surfaces 224 of the surface features are inwardly spaced from the vertical side walls 140, 142 of the channel 130. This spaced relationship allows the vertically hanging flap 20 to move in the horizontal direction, as occurs when a pet passes through the pet opening 50. Thus, the flap 20 is hingedly movable when mounted within the channel 130 to allow the ergess and ingress of a pet into and out of the enclosure.

A significant feature of the space frame 14 of the invention is that it mounts the flap 20 at a central location in the pet door assembly 10. Hence, the space frame 14 provides sufficient integrally formed structure that mounts and retains the flap 20 in the inner frame.

The assembly and operation of the pet door assembly 10 of FIGS. 1–11 is as follows. The door sill 150 is secured to the mounting structure 166 of the inner frame 14 by positioning the door sill over the sill mounting structure 164 and the magnets 152 within the corresponding cutouts 168, 170. The door sill 150 is then positioned at a selected vertical position by disposing the bolt 176 through both the slot 156 and the fastener-receiving aperture 174 of the mounting structure 166. The screw 176 is then tightened and fastened to the inner frame 14 by way of nut 178. Those of ordinary skill will readily recognize that the slot 156 provides a number of vertical positions in which the door sill can be placed. The desired vertical position is that position where the magnets 210, 212 of the vertically hung flap 20 magnetically engage the magnets 152 of the door sill 150.

The flap 20 is hingedly secured in the channel 130 by sliding the flap into the channel until the flap surface features 220 pass the protrusions 138 and engage the ledge 134 of the channel. The inner frame 14 is then placed and positioned within the hole cut into the wall of the enclosure in the conventional manner.

The front and rear frame members 12 and 16, respectively, are placed on either side of the inner frame 14. Specifically, the front frame member 12 seats over the opening on the inner side of the enclosure, and the rear external frame member 16 seats over the opening on the outer side of the enclosure. The fastener-receiving apertures 58, 110 of the frame members are aligned with the respective apertures 184, 186 of the fastener brackets 180. The frame members 12, 16 are secured to the inner frame 14 by positioning the mechanical fasteners within the frame apertures and the corresponding aperture of the fastener bracket. Specifically, the rear frame member 16 is secured to the inner frame 14 by disposing fasteners 114 within apertures 110 and within the larger diameter apertures 184 of the fastener brackets 180. The fasteners 114 are secured to the inner frame 14 by the spin nut 190 of FIG. 6. Similarly, the front frame member 12 is secured to the inner frame 14 by disposing fasteners 60 within apertures 58 and within the smaller diameter apertures 186 of the brackets 180.

The security cover 18 is then positioned within the cover-receiving slot 38 of the front external frame member 12, and slid downwardly. The cover is secured within the frame channels 42 by the mating engagement of the cover rails 68 and the frame bosses 40, as well as by the locking arrangement of the tab-like protrusion 76 with the frame aperture 54 and the latching rail 78 with the frame transverse wall 44B.

A significant feature of the present invention is that the locking arrangement of the security cover 18 and the front frame 12 prevents a force applied normal to the cover surface from dislodging the cover from the channels 42. This provides significant advantages over conventional designs where the cover can be extruded out of the cover-mounting channels by a force applied normally to the cover. Furthermore, the centrally-mounted door flap provides for relatively easy mounting of the flap while concomitantly reducing the piece-count and complexity of the pet door assembly.

Figure 12:
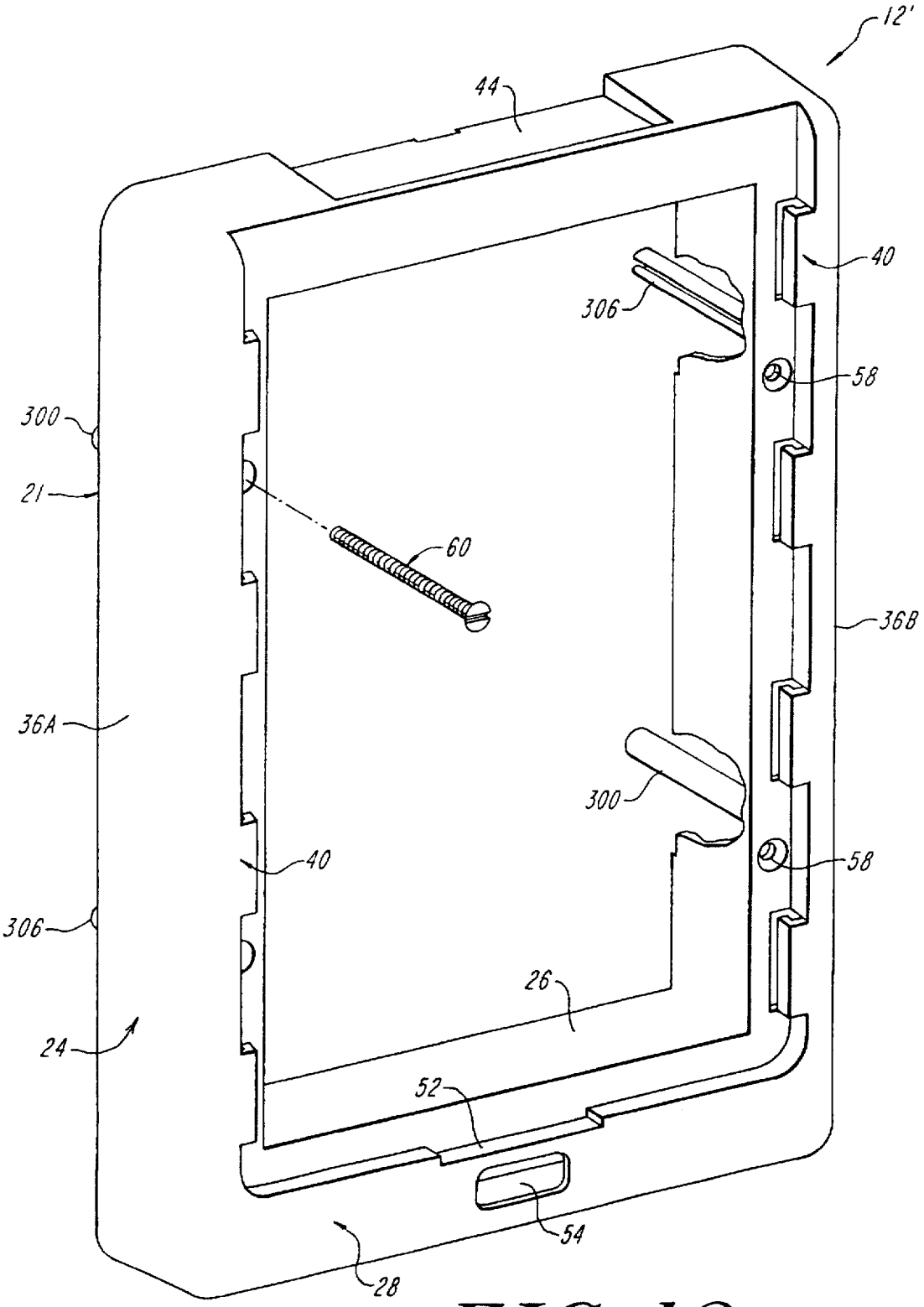
FIG. 12 is a perspective view of a second embodiment of the front external frame member of the present invention.
Figure 15:
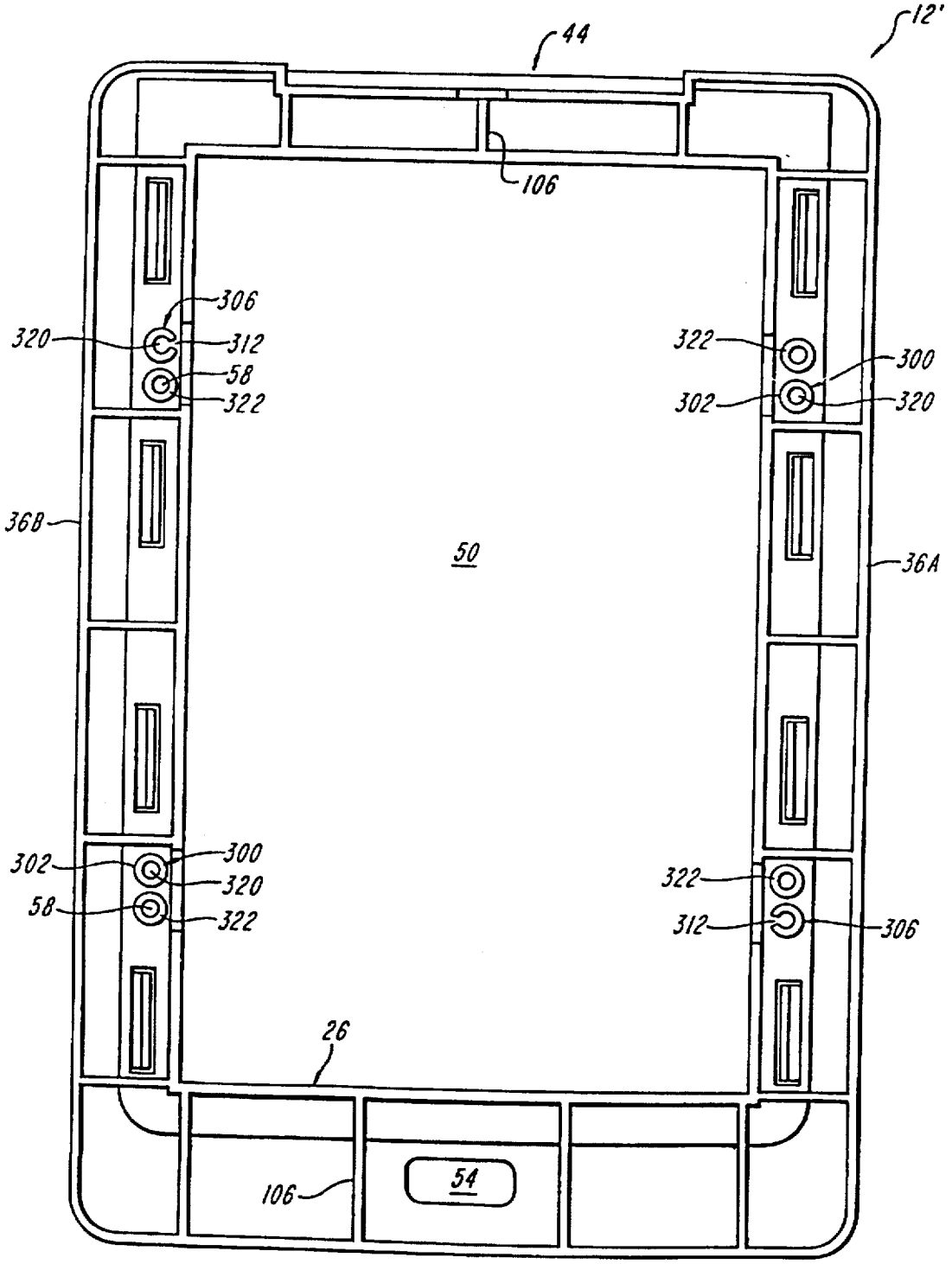
FIG. 15 is a rear end view of a the front external frame member of FIG. 12.

FIG. 12 illustrates a second embodiment of the front exterior frame member 12' of the present invention. Like parts are designated with like reference numerals throughout the different views. The illustrated frame 12' includes a unitary main body 21 that is nearly identical to the frame member shown and described in FIGS. 1 and 2A–2B. As illustrated, the front frame member 12' includes the unitary body 21, a series of bosses 40 formed along opposed vertical edges 36A and 36B, and a set of fastener-receiving apertures 58. The fastener-receiving apertures 58 are preferably formed at positions that are staggered with respect to the apertures formed in the opposing vertical side. For example, the apertures 58 formed along the leftmost vertical side 36A are located at horizontal positions vertically above the apertures 58 formed along the rightmost vertical side 36B. FIG. 15 clearly illustrates the spaced, staggered relationship between the apertures 58 formed on each vertical side of the frame member 12.

The illustrated front external frame member 12 further includes a set of fastener sleeves 300 and 306 which are integrally formed with the frame member 12 and extend outwardly from a rear surface 29 thereof. Referring to FIGS. 12 and 15, the fastener mounts 306 include an elongate main body 310 that has an elongate slot or slit 312 that forms a mount having a generally C-shaped profile. The other pair of fastener sleeves 300 have an elongate main body 302 that preferably extends outwardly from the frame member rear surface 29, and which are devoid of elongate slits. The fastener sleeves 300 and 306 define an additional set of fastener-receiving apertures 320 which are adapted to seat mechanical fasteners, e.g., self-threading screws 60.

The illustrated fastener sleeves 306 and 300 are preferably vertically spaced apart along each vertical side 36A, 36B. The fastener sleeves are further positioned at locations along each vertical side that are staggered with respect to the fastener sleeves formed in the opposing vertical side. For example, fastener sleeves 306 and 300 formed along the leftmost vertical edge 36B are located at positions vertically above the fastener sleeves formed along the rightmost vertical side 36A. Additionally, the fastener sleeves 306 are preferably located on opposing vertical sides and opposite corners of a path formed by the sleeves 300, 306 that bounds a quadrilateral.

The rear surface 29 further includes a set of aperture bosses 322 that are in registration with the fastener-receiving apertures 58 formed on the front surface 28 of the frame member 12'. These bosses 322 are preferably vertically aligned with the fastener sleeves 300, 306 in a selected manner. For example, as shown in FIG. 15, the aperture bosses 322 formed along vertical side 36B are positioned vertically below the fastener sleeves 300, 306, and the bosses 322 formed along vertical side 36A are positioned vertically above the sleeves 300, 306.

With further reference to FIGS. 12 and 15, the fastener-receiving apertures 58 formed along vertical sides 36A, 36B are positioned at locations that are either vertically above or vertically below the horizontal positions of the fastener sleeves 300 and 306. This selected spatial arrangement between fastener-receiving apertures 58 and fastener sleeves 300 and 306 allow the exterior frame members 12', 16' and the inner frame 14' to be assembled in a selected manner, as described in further detail below.

Figure 14:
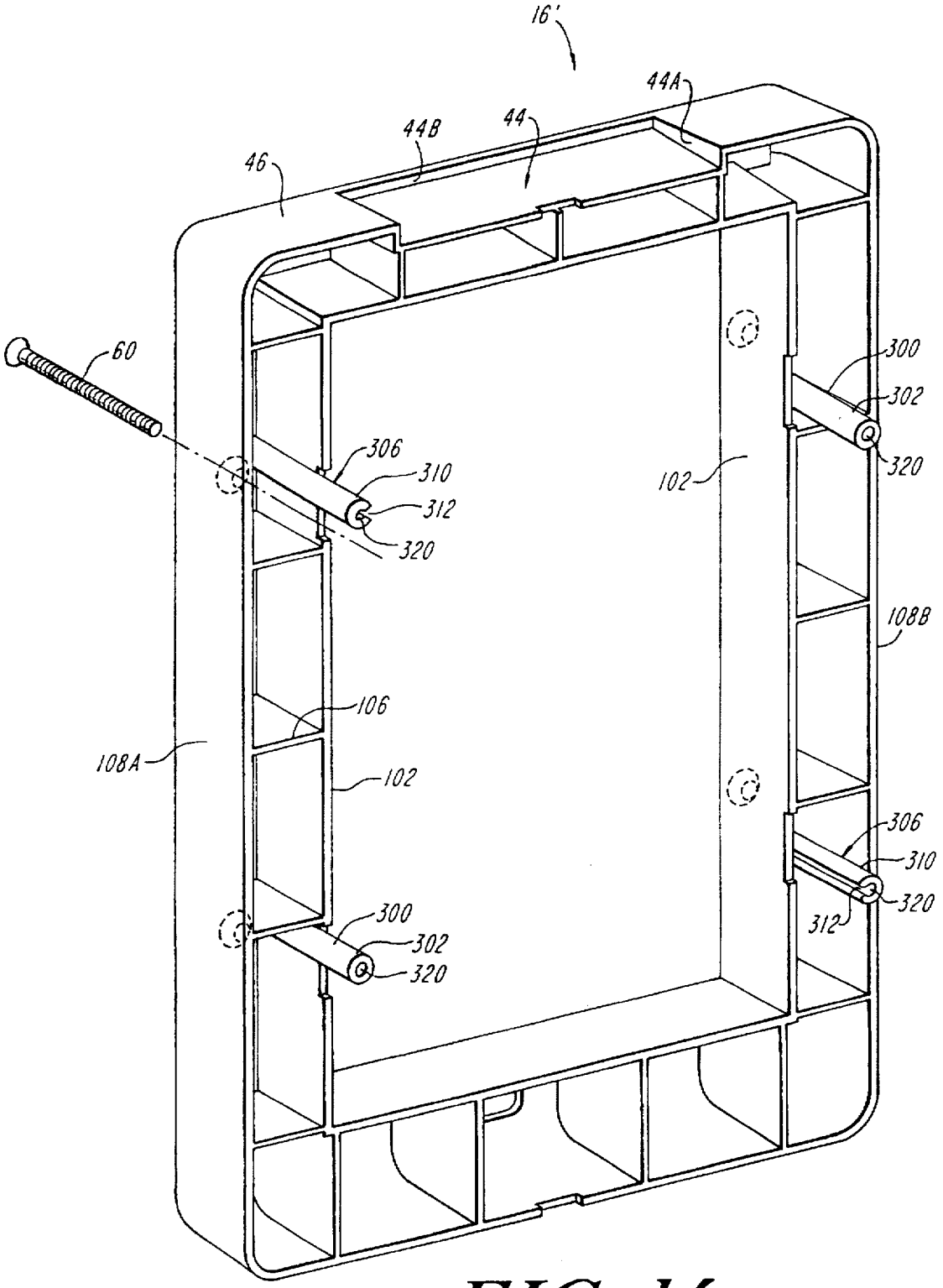
FIG. 14 is a perspective view of a second embodiment of the rear external frame member of the present invention.

FIG. 14 illustrates a second embodiment of the rear external frame member 16' of the present invention. The illustrated frame 16' is essentially identical to the rear frame member 16 of FIG. 8, but also includes the fastener sleeves 300, 306, which are identical to those described above.

Figure 13:
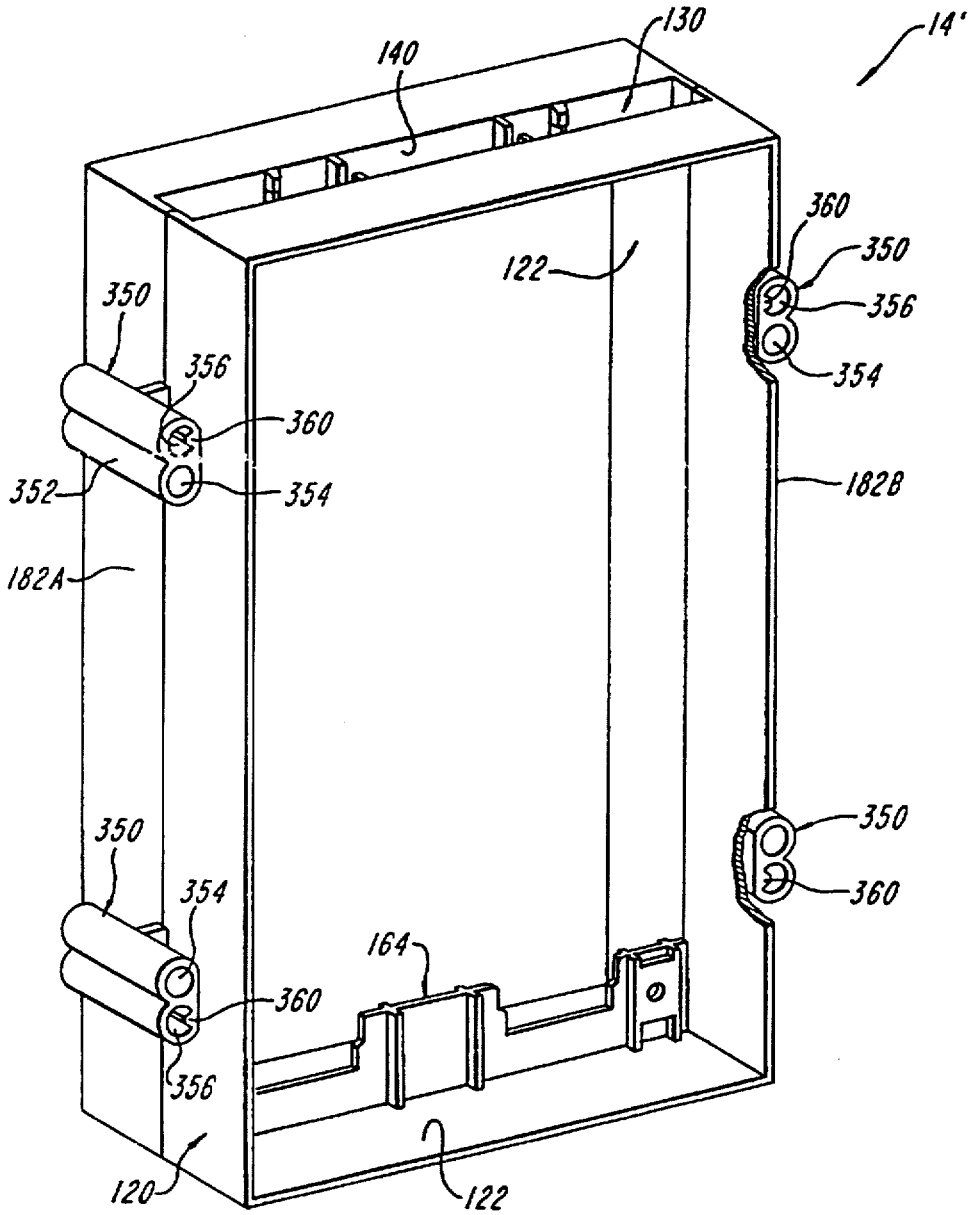
FIG. 13 is a perspective view of a second embodiment of the inner frame, with a portion of the inner frame partly broken away to show features of the fastener brackets, according to one aspect of the present invention.

FIG. 13 shows a second embodiment of the inner frame 14' according to another aspect of the present invention. Like frame parts are designated throughout the views with like reference numerals. The illustrated inner frame 14' is essentially identical to the inner frame 16 of FIG. 6, except for the illustrated fastener brackets 350. The inner frame 14' thus has a substantially rectangular main body having an outer peripheral surface 120 and an inner peripheral surface 122. The inner frame also includes a channel 130 formed in a top portion of the inner frame 14. The channel is preferably configured to seat a door flap of the type shown and described in FIG. 7.

The inner frame 14' further includes a sill mounting structure 164. The sill mounting structure preferably seats a door sill 150 which mounts a pair of magnets 152. The operation and function of the door sill and magnets has been described above in relation to FIGS. 5, 6 and 9.

Each vertical side 182A, 182B of the illustrated inner frame 14' includes a pair of integrally formed fastener brackets 350 that are vertically spaced apart along the height of the frame. The fastener brackets 350 include an outer main body 352 which includes a pair of parallel and vertically aligned apertures 354, 356. Aperture 356 formed in each fastener bracket 350 preferably includes a key portion 360 that extends substantially along the length of the aperture 356. The diameter of the apertures 354, 356 are preferably greater than the outer diameter of the fastener sleeves 300, 306. This specific sizing arrangement allows the fastener sleeves 300, 306 to horizontally seat within the fastener brackets 350 when assembled.

Figure 16:
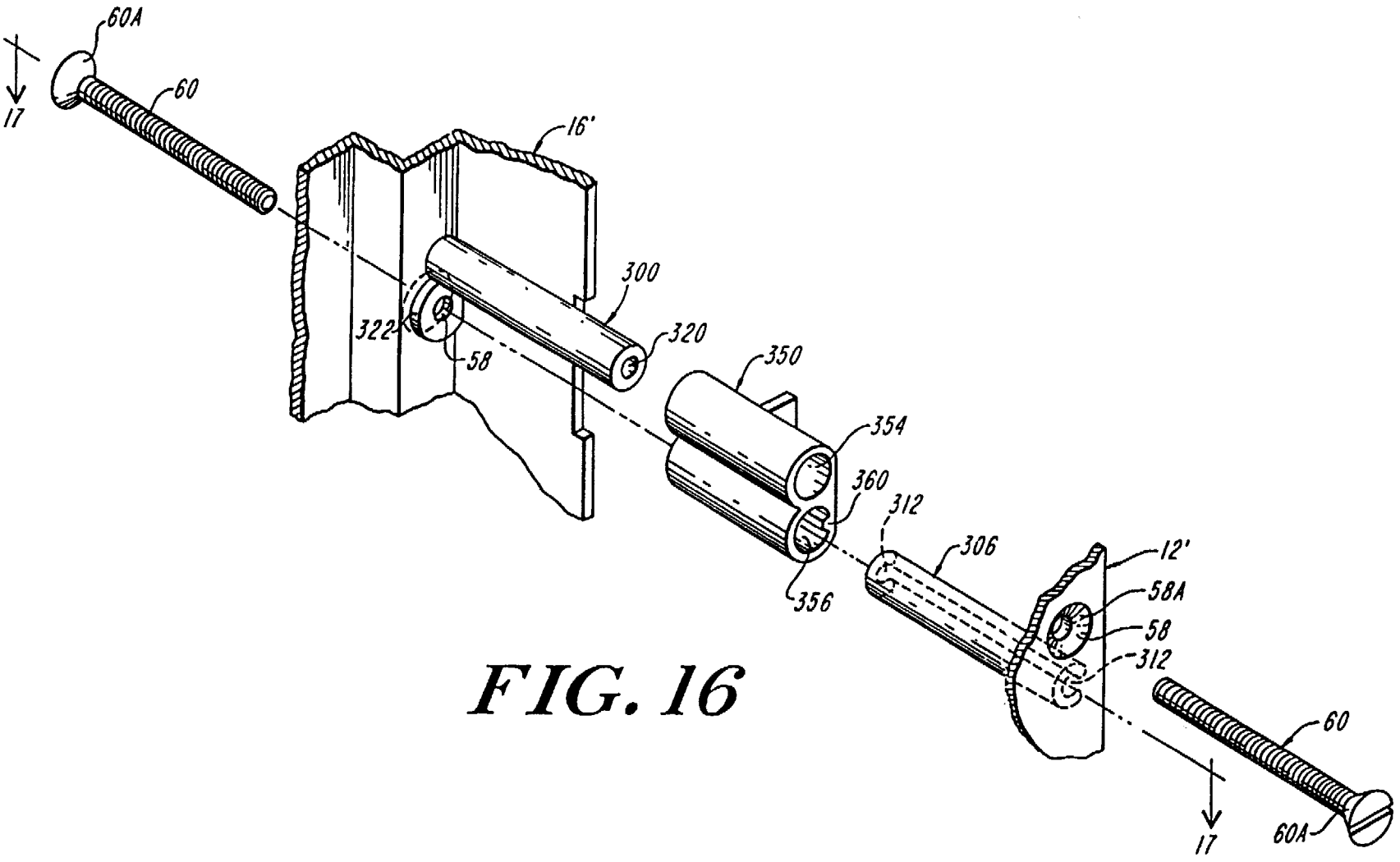
FIG. 16 is a fragmentary exploded view of the fastening mechanism of the present invention for securing the inner frame to the external frame members.
Figure 18:
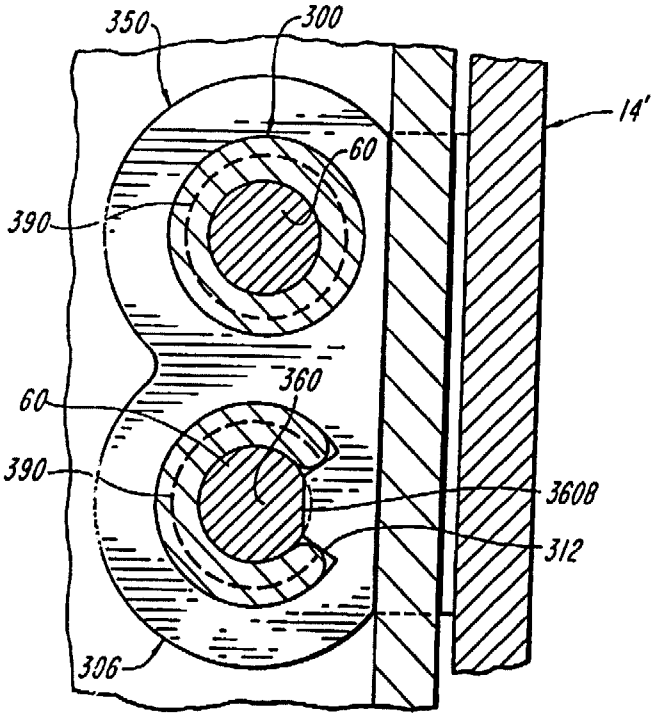
FIG. 18 is a cross-sectional view taken along lines 18—18 of FIG. 17 illustrating a fastener mounted within the fastener bracket of FIG. 13.
Figure 17:
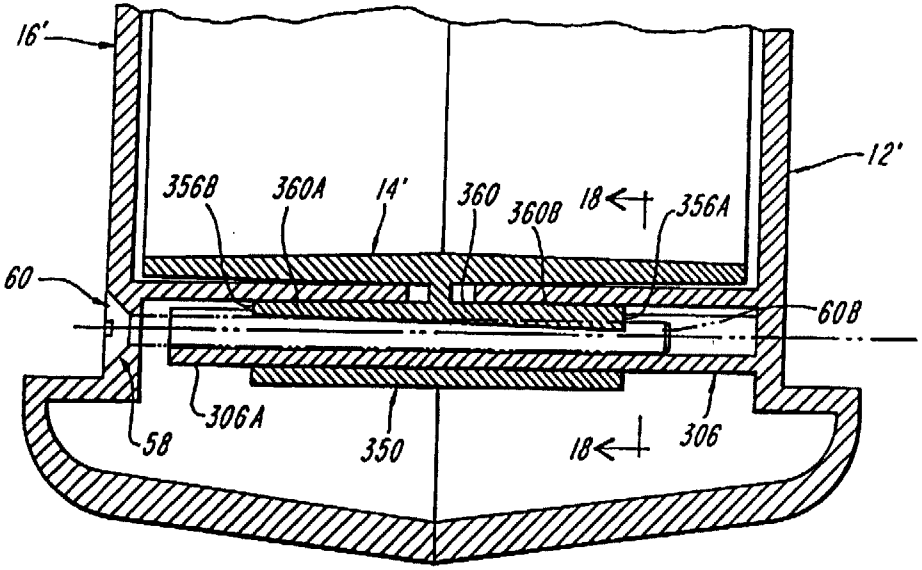
FIG. 17 is a cross-sectional view taken along lines 17—17 of FIG. 16 illustrating the key portion of the fastener brackets of the present invention.

FIGS. 16–18 illustrate the mating mounting relationship between the fastener sleeves 300, 306 and the fastener brackets 350 when the exterior frames 12', 16' are assembled with the inner frame 14'. FIG. 16 is an exploded fragmentary view of the pet door, according to one practice, that corresponds to the lower left portion of the front and rear frame members 12' and 16' of FIGS. 12 and 14. The illustrated fastener sleeve 306 of the front external frame member 12' is vertically positioned beneath the fastener-receiving aperture 58. The fastener-receiving aperture 58 preferably includes a conical seat 58A which is complementary in shape to the conical under-surface 60A of the head portion of the fastener 60. The rear external frame member 16' includes an outwardly extending fastener sleeve 300 which is located vertically above the fastener-receiving aperture 58. The rear surface of the frame member 16' includes a boss portion 322 that extends outwardly from the frame rear surface, and is positioned beneath the sleeve 300. The aperture 58 is preferably in registration with aperture 356 of the fastener bracket 350 and with the sleeve 306. Likewise, the fastener-receiving aperture 58 of external frame 12' is preferably in registration with the aperture 354 of the bracket 350 and with the sleeve 300.

The frame members 12', 14' and 16' are preferably assembled by aligning the fastener sleeves 300, 306 with the corresponding apertures 354, 356 of the fastener bracket 350. According to one practice, the fastener sleeve 300 seats within aperture 354 of the fastener bracket 350. Likewise, the outwardly extending fastener sleeve 306 of the front external frame member 12' seats within aperture 356. In this orientation, the elongated slot 312 formed in the fastener sleeve 306 aligns with and engages the key portion 360 formed within the aperture 356. The mating engagement of the key portion 360 with the slot 312 provides for a relatively tight interlocking fit which secures the front external frame member 12' to the inner frame member 14'. The fasteners 60 are then mounted within the fastener apertures 58 and threaded into the apertures 322 defined by the fastener sleeves 300, 306 seated within apertures 354, 356 of the fastener bracket 350.

According to another practice, when the fastener sleeve 306 is formed on the rear surface of the rear external frame member 16', the key portion 360 is formed within aperture 356, which is disposed vertically above the aperture 354. The mating engagement of the key portion 360 and sleeve 306 secures the rear external frame 16' to the inner frame 14'. This selected configuration is exemplified by a fragmentary view of the upper left portion of the front and rear external frame members 12', 16' and the inner frame 14'.

FIGS. 17 and 18 illustrate the mating engagement between the fastener sleeve 306 of the front frame member 12 and the fastener bracket 350 and fastener 60. The illustrated fastener sleeve 306 seats within aperture 356 of bracket 350. The outer diameter of the fastener sleeve 306 is slightly smaller than the inner diameter of the aperture 356 to provide for a slidingly engageable fit between the sleeve and aperture inner surface. The illustrated key portion 360 seats within the slit 312, and is preferably shaped complementary thereto. The mating engagement between the slit 312 and key portion 360 positions the exterior frame member 12' relative to the inner frame member 14', while concomitantly securing the two frames together.

The key portion 360 preferably has a first key portion 360A which has a first selected height or thickness and a second key portion 360B having a second selected height or thickness that is greater than the first selected thickness. As illustrated in FIG. 17, the key portion 360 has a selected taper which extends from a first aperture end 356A to a second aperture end 356B and away from the rear surface of the frame member. According to a preferred practice, the key portion 360 preferably gradually increases in height along the length of the aperture 356 in the direction towards the rear surface of the frame member, for example, front external frame member 12'.

The first key portion 360A preferably slidingly engages a selected of the slit 312 and extends partly therein when the sleeve 306 and fastener bracket 350 are assembled. As the sleeve 306 engages an increasing portion of the key 360, the second key portion 360B further extends into the slit 312 until that portion completely fills the slotted portion of the sleeve 306. This filled assemblage is shown in FIG. 18. As shown therein, the second key portion 360B fully engages and fills the slot 312 to form a substantially cylindrical sleeve similar to fastener sleeve 300.

The second key portion 360B preferably protrudes into the slit 312 of the fastener sleeve 306 and presents additional structure within the aperture for engagement with the threaded fastener 60. Specifically, when the illustrated frame members 12', 14', 16' are assembled together, the fastener 60 is mounted within fastener aperture 58 where it engages a first end 306A of the fastener sleeve 306. The fastener 60 is then threaded into the body of the fastener sleeve 306. The height of the first key portion 360A is selected to be small enough such that it does not engage the threads 390, FIG. 18, of the fastener. The first key portion 360A thus serves to guide the rear end 60B of the fastener into the aperture 320.

The tapered configuration of the key portion 360 ensures that the fastener 60 fully engages the key portion 360, and particularly the second key portion 360B. The rear end 60B of the fastener engages the second key portion 360B which protrudes into and fills the slit 312. The fastener 60 thus threadingly captures the front external frame member 12' via the fastener sleeve 306 and the inner frame 14' via the key portion 360 of the fastener bracket 350. When fully assembled, the threading engagement of the fastener 60 with the key portion 360 of the fastener bracket 350 and the fastener sleeve, as well as the mating engagement of the slit 312 and key portion 360, fully secures the inner frame to one or more of the exterior frame members. This lock-tight fit thus prevents movement of the exterior frame member 12' or 14' relative to the inner frame 14'.

With further reference to FIGS. 12 through 18, the remaining fastener brackets 350 with the selected orientation of apertures 354 having key portions 360 secure both the front and rear external frame members 12' and 16' to the inner frame member 14', while concomitantly preventing relative axial movement of the inner frame 14' relative to either or both of the external frame members 12', 16'.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A pet door assembly for insertion within a hole formed in a wall of an enclosure, comprising a pair of exterior frames for mounting to opposite sides of the wall and about the hole, each frame defining an opening for allowing passage of a pet, each said exterior frame including a rear surface having a plurality of fastener sleeves extending outwardly therefrom, at least one of said sleeves having a longitudinally extending slot formed therein, and a central inner frame located between said pair of exterior frames for insertion within the hole, said inner frame defining an opening generally aligned with said openings in said exterior frames, said central frame having at least one fastener bracket formed along opposed edges of said inner frame, at least one of said brackets including a fastener-receiving aperture having a key portion formed therein, said key portion being configured to seat within said longitudinal slot formed within said fastener sleeve to prevent, when assembled, movement of said inner frame relative to one of said exterior frames.

2. The pet door assembly of claim 1 further including assembly means for securing said exterior frames and said central inner frame together.

3. The pet door assembly of claim 1 wherein said inner frame further includes mounting means formed in a top portion thereof for mounting a door flap overlying the opening in said inner frame.

4. The pet door assembly of claim 3 wherein said mounting means includes means defining a channel.

5. The pet door assembly of claim 1 wherein said fastener brackets formed along said edges of said inner frame are adapted, when disposed in a first orientation, for horizontally receiving mechanical fasteners to fasten each said exterior frame to said inner frame.

6. The pet door assembly of claim 1 wherein each said fastener bracket defines first and second fastener-receiving apertures having a selected length, said fastener-receiving apertures being vertically or horizontally aligned.

7. The pet door assembly of claim 6 wherein said key portion is formed within one of said first and second fastener-receiving apertures, said key portion including a first portion having a first height which extends at least partly along the length of said aperture, and a second portion having a second height which extends at least partly along said aperture, said first height being greater than said second height.

8. The pet door assembly of claim 7 wherein said first height of said first key portion extends substantially from a middle region of said fastener-receiving aperture to a first side of said inner frame.

9. The pet door assembly of claim 6 wherein each exterior frame has attachment means formed on a front surface at locations corresponding to said location of said fastener sleeves formed on the other of said exterior frames for attaching said exterior frame members to said inner frame.

10. The pet door assembly of claim 9 wherein said attachment means of one of said exterior frames is aligned with said first fastener-receiving aperture of said fastener bracket, and one of said fastener sleeves of said other exterior frame is in registration with said first aperture, and wherein said attachment means of said other exterior frame is aligned with said second fastener-receiving aperture of said fastener bracket and one of said fastener sleeves of said one exterior frame is in registration with said second aperture.

11. A pet door assembly for insertion within a hole formed in a wall of an enclosure, comprising a pair of exterior frames for mounting to opposite sides of the wall and about the hole, each frame defining a opening for allowing passage of a pet, a central inner frame located between said pair of exterior frames for insertion within the hole, said inner frame defining an opening generally aligned with said openings in said exterior frames, retention means for preventing, when assembled, movement of said inner frame relative to one of said exterior frames, said retention means including a plurality of fastener sleeves associated with a rear surface of each exterior frame and extending outwardly therefrom, at least one of said sleeves having a longitudinally extending slot form therein, and at least one fastener bracket formed on opposed edges of said inner frame, at least one of said brackets including a fastener-receiving aperture having a key portion formed therein, said key portion being configured to seat within said slot formed within said fastener sleeve, and assembly means for securing said exterior frames and said central inner frame together.

12. The pet door assembly of claim 11 wherein each said fastener bracket defines first and second fastener-receiving apertures having a selected length, said fastener-receiving apertures being vertically or horizontally aligned.

13. The pet door assembly of claim 12 wherein said key portion is formed within one of said first and second fasterner-receiving apertures, said key portion including a first portion having a first height which extends at least partly along the length of said aperture, and a second portion having a second height which extends at least partly along said aperture, said first height being greater than said second height.

14. The pet door assembly of claim 13 wherein said first height of said first key potion extends substantially from a middle region of said fastener-receiving aperture to a first side of said inner frame.

15. The pet door assembly of claim 12 wherein each exterior frame has attachment means formed on a front surface at locations corresponding to said location of said fastener sleeves formed on the other of said exterior frames for attaching said exterior frame members to said inner frame.

16. The pet door assembly of claim 15 wherein said attachment means of one of said exterior frames is aligned with said first fastener-receiving aperture of said fastener bracket, and one of said fastener sleeves of said other exterior frame is in registration with said first aperture, and wherein said attachment means of said other exterior frame is aligned with said second fastener-receiving aperture of said fastener bracket and one of said fastener sleeves of said one exterior frame is in registration with said second aperture.

* * * * *